US009764562B2

(12) United States Patent
Suzuki et al.

(10) Patent No.: US 9,764,562 B2
(45) Date of Patent: Sep. 19, 2017

(54) PRINTING APPARATUS AND DRIVING CONTROL METHOD FOR PRINTHEAD

(71) Applicant: CANON KABUSHIKI KAISHA, Tokyo (JP)

(72) Inventors: Fumiko Suzuki, Kawasaki (JP); Atsuhiko Masuyama, Yokohama (JP); Norihiro Kawatoko, Yokohama (JP); Yoshiyuki Honda, Yokohama (JP); Yutaka Kano, Yokohama (JP); Hitoshi Nishikori, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/858,374

(22) Filed: Sep. 18, 2015

(65) Prior Publication Data

US 2016/0096364 A1 Apr. 7, 2016

(30) Foreign Application Priority Data

Oct. 7, 2014 (JP) ..... 2014-206673

(51) Int. Cl.

| | |
|---|---|
| ***B41J 2/155*** | (2006.01) |
| ***B41J 2/21*** | (2006.01) |
| ***B41J 2/045*** | (2006.01) |

(52) U.S. Cl.

CPC ..... *B41J 2/2139* (2013.01); *B41J 2/0458* (2013.01); *B41J 2/04543* (2013.01); *B41J 2/04545* (2013.01); *B41J 2/04546* (2013.01); *B41J 2/04568* (2013.01); *B41J 2/04573* (2013.01); *B41J 2/155* (2013.01); *B41J 2/2135* (2013.01); *B41J 2/2142* (2013.01); *B41J 2/2146* (2013.01)

(58) Field of Classification Search

CPC B41J 2/04505; B41J 2/04546; B41J 2/04573; B41J 2/155

See application file for complete search history.

(56) References Cited

U.S. PATENT DOCUMENTS

| | | | |
|---|---|---|---|
| 7,192,112 | B2 | 3/2007 | Nakanishi et al. |
| 7,192,114 | B2 | 3/2007 | Suzuki et al. |
| 7,618,116 | B2 | 11/2009 | Hamasaki et al. |
| 7,651,194 | B2 | 1/2010 | Yazawa et al. |
| 7,690,744 | B2 | 4/2010 | Nakanishi et al. |
| 7,959,246 | B2 | 6/2011 | Hamasaki et al. |
| 8,864,266 | B2 | 10/2014 | Suzuki et al. |

(Continued)

FOREIGN PATENT DOCUMENTS

| | | |
|---|---|---|
| JP | 2012-030594 A | 2/2012 |

*Primary Examiner* — Kristal Feggins
*Assistant Examiner* — Kendrick Liu
(74) *Attorney, Agent, or Firm* — Fitzpatrick, Cella, Harper & Scinto

(57) ABSTRACT

In a printing apparatus including a printhead and a print control unit, wherein the printhead includes two nozzle arrays, each arranged in a first direction and including nozzles arranged along a second direction, the print control unit performs a first operation of expanding print data onto a memory, a second operation of selecting, for each nozzle array, some of the nozzles as non-driving nozzles and the remaining nozzles as driving nozzles, and a third operation of distributing the expanded print data to the two nozzle arrays such that dots corresponding to the non-driving nozzles of one nozzle array are printed by the driving nozzles of the other nozzle array.

12 Claims, 27 Drawing Sheets

(56) References Cited

U.S. PATENT DOCUMENTS

| | | | | |
|---|---|---|---|---|
| 9,174,436 | B2 | 11/2015 | Suzuki et al. | |
| 2010/0156975 | A1* | 6/2010 | Morooka | B41J 2/2139<br>347/14 |
| 2012/0274949 | A1* | 11/2012 | Masuda | G06K 15/107<br>358/1.2 |
| 2012/0274951 | A1 | 11/2012 | Nishikori et al. | |
| 2016/0096363 | A1* | 4/2016 | Kawatoko | B41J 2/155<br>347/12 |

* cited by examiner

FIG. 5A
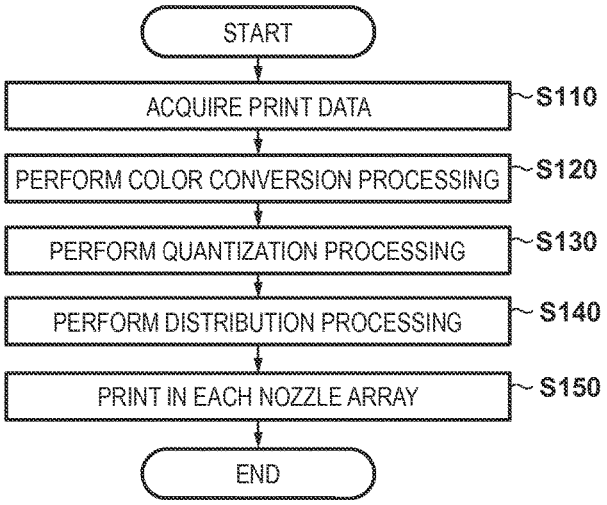
FIG. 5C
| Lv | NUMBER OF DOTS |
|---|---|
| 0 | 0 |
| 1 | 1 |
| 2 | 2 |
| 3 | 3 |
FIG. 5B
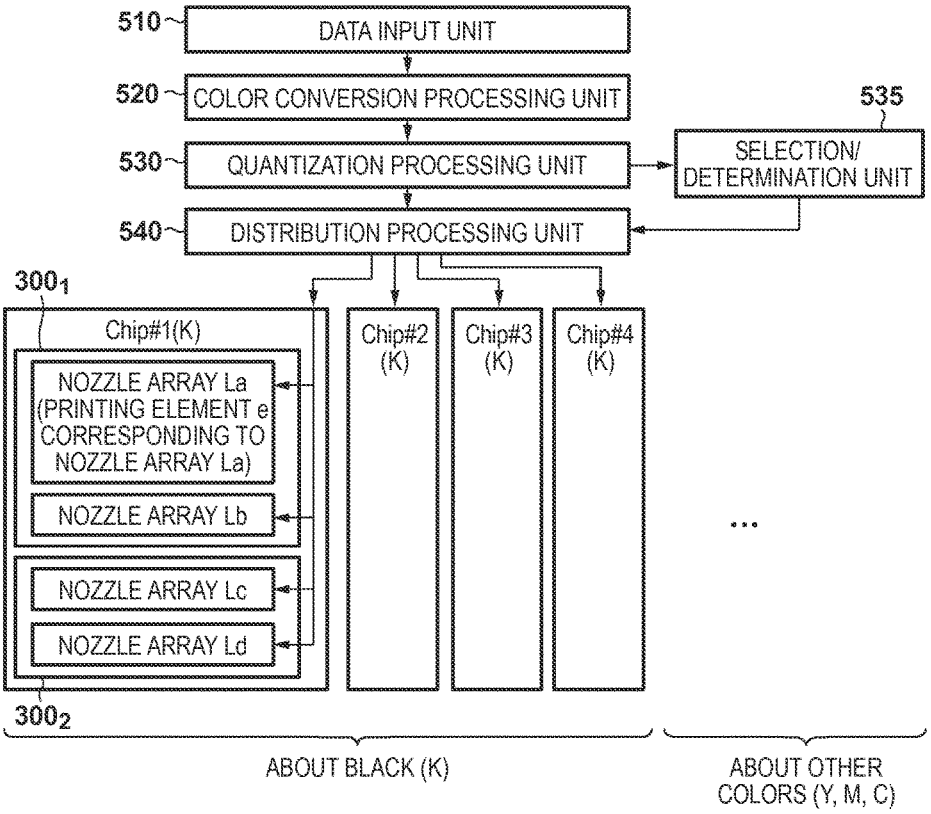

FIG. 7C

X (CONVEYING DIRECTION)

Y (NOZZLE ARRAY DIRECTION)

| B# | clm1 | clm2 | clm3 | clm4 |
|---|---|---|---|---|
| 1 | cda | dab | abc | bcd |
| 2 | dac | abd | bca | cdb |
| 3 | acd | bda | cab | dbc |
| 4 | cda | dab | abc | bcd |
| 5 | dab | abc | bcd | cda |
| 6 | abd | bca | cdb | dac |
| 7 | bda | cab | dbc | acd |
| 8 | dab | abc | bcd | cda |
| 9 | abc | bcd | cda | dab |
| 10 | bca | cdb | dac | abd |
| 11 | cab | dbc | acd | bda |
| 12 | abc | bcd | cda | dab |
| 13 | bcd | cda | dab | abc |
| 14 | cdb | dac | abd | bca |
| 15 | dbc | acd | bda | cab |
| 16 | bcd | cda | dab | abc |

TP1

X (CONVEYING DIRECTION)

Y (NOZZLE ARRAY DIRECTION)

FIG. 9C

| B# | clm1 | clm2 | clm3 | clm4 |
|---|---|---|---|---|
| 1 | cda | dab | abc | bcd |
| 2 | acd | abd | bca | cdb |
| 3 | bda | cab | dbc | acd |
| 4 | cab | dbc | acd | bda |
| 5 | bcd | cda | dab | abc |
| 6 | cdb | acd | abd | bca |
| 7 | acd | bda | cab | dbc |
| 8 | bda | cab | dbc | acd |
| 9 | abc | bcd | cda | dab |
| 10 | bca | cdb | acd | abd |
| 11 | dbc | acd | bda | cab |
| 12 | acd | bda | cab | dbc |
| 13 | dab | abc | bcd | cda |
| 14 | abd | bca | cdb | acd |
| 15 | cab | dbc | acd | bda |
| 16 | dbc | acd | bda | dbc |

TP2

FIG. 11

X (CONVEYING DIRECTION)

Y (NOZZLE ARRAY DIRECTION)

| B# | clm1 | clm2 | clm3 | clm4 | clm5 | clm6 | clm7 | clm8 | clm9 | clm10 | clm11 | clm12 |
|---|---|---|---|---|---|---|---|---|---|---|---|---|
| 1 | cda | dab | abc | bcd | dac | abd | bca | cdb | acd | bda | cab | dbc |
| 2 | dac | abd | bca | cdb | acd | bda | cab | dbc | cda | dab | abc | bcd |
| 3 | acd | bda | cab | dbc | cda | dab | abc | bcd | dac | abd | bca | cdb |
| 4 | cda | dab | abc | bcd | dac | abd | bca | cdb | acd | bda | cab | dbc |
| 5 | dab | abc | bcd | cda | abd | bca | cdb | dac | bda | cab | dbc | acd |
| 6 | abd | bca | cdb | dac | bda | cab | dbc | acd | dab | abc | bcd | cda |
| 7 | bda | cab | dbc | acd | dab | abc | bcd | cda | abd | bca | cdb | dac |
| 8 | dab | abc | bcd | cda | abd | bca | cdb | dac | bda | cab | dbc | acd |
| 9 | abc | bcd | cda | dab | bca | cdb | dac | abd | cab | dbc | acd | bda |
| 10 | bca | cdb | dac | abd | cab | dbc | acd | bda | abc | bcd | cda | dab |
| 11 | cab | dbc | acd | bda | abc | bcd | cda | dab | bca | cdb | dac | abd |
| 12 | abc | bcd | cda | dab | bca | cdb | dac | abd | cab | dbc | acd | bda |
| 13 | bcd | cda | dab | abc | cdb | dac | abd | bca | dbc | acd | bda | cab |
| 14 | cdb | dac | abd | bca | dbc | acd | bda | cab | bcd | cda | dab | abc |
| 15 | dbc | acd | bda | cab | bcd | cda | dab | abc | cdb | dac | abd | bca |
| 16 | bcd | cda | dab | abc | cdb | dac | abd | bca | dbc | acd | bda | cab |

TP3

SHUFFLE

SAME AS TP1

PRIORITY LEVELS OF EACH COLUMN AND EACH BLOCK ARE SHUFFLED

FIG. 14A
| Lv. | NUMBER OF DOTS |
|---|---|
| 0 | 0 |
| 1 | 2 |
| 2 | 4 |
| 3 | 6 |
| 4 | 8 |
FIG. 14B
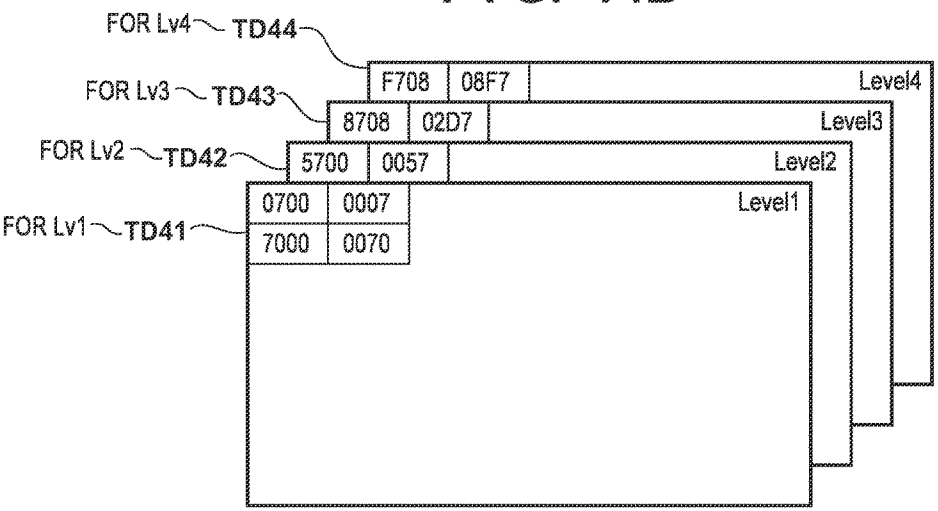
FIG. 14C
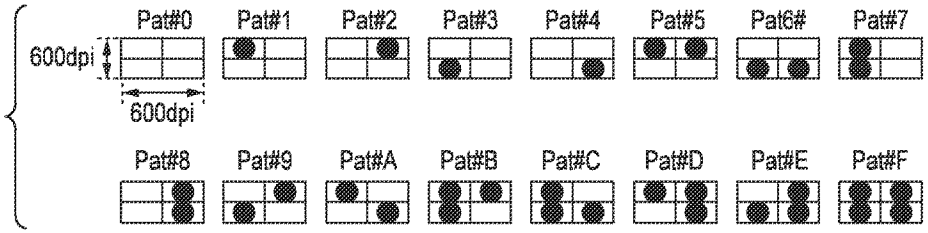

FIG. 15A1
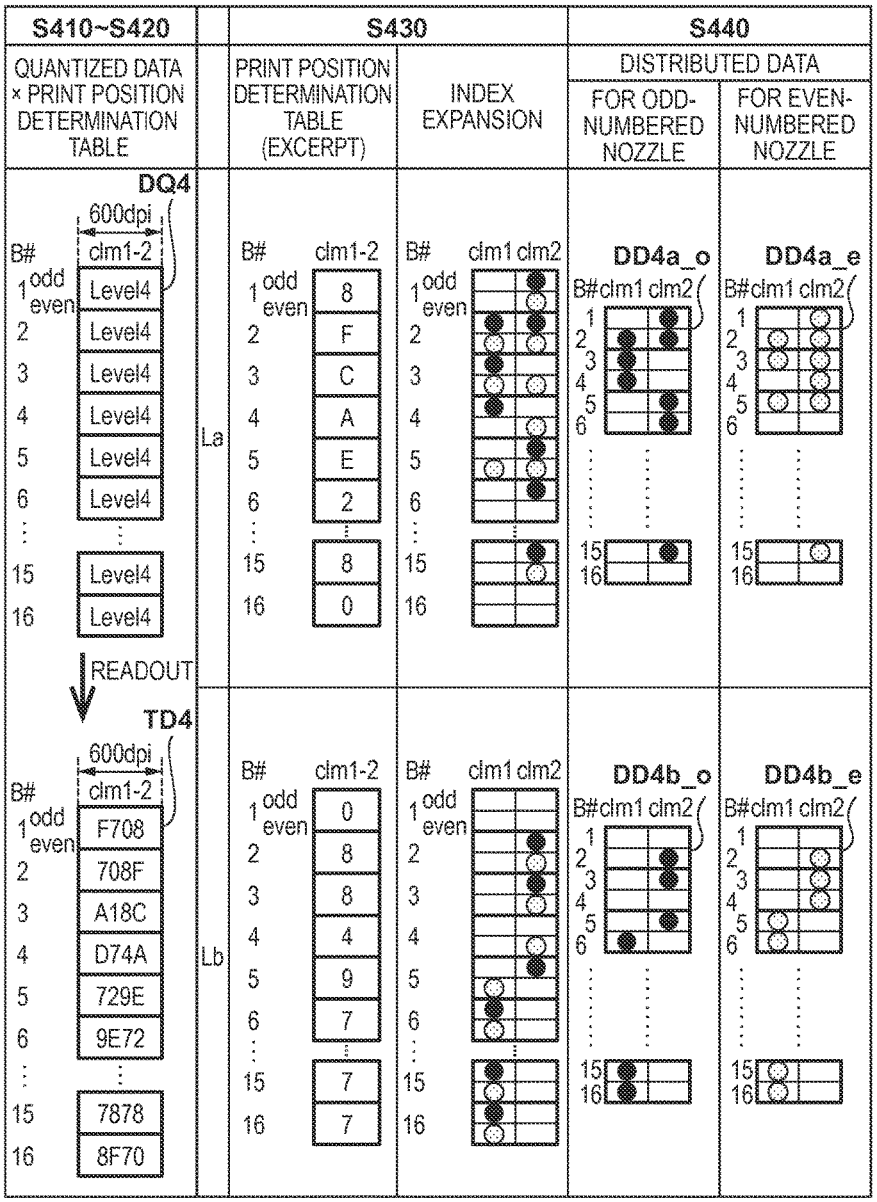

FIG. 15A2
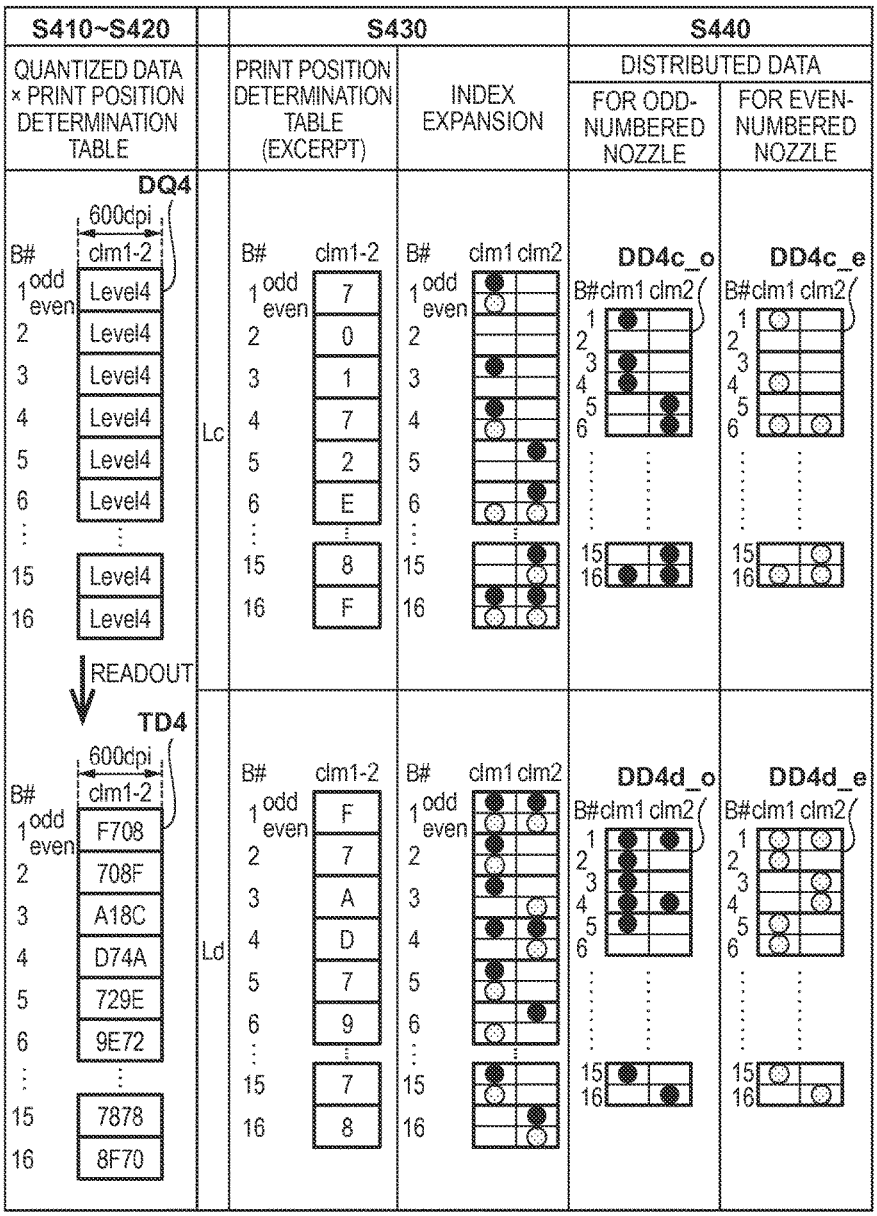

FIG. 16

| L | NUMBER OF NOZZLE ARRAYS | 2 | | | | 4 | | | | | | 8 | | | | | | |
|---|---|---|---|---|---|---|---|---|---|---|---|---|---|---|---|---|---|---|
| M | NUMBER OF DRIVING BLOCKS | 16 | 16 | 16 | 16 | 16 | 16 | 16 | 16 | 16 | 16 | 16 | 16 | 16 | 16 | 16 | 16 | 16 |
| P | NUMBER OF DRIVING NOZZLES | 8 | 10 | 12 | 16 | 4 | 8 | 12 | 14 | 15 | 16 | 2 | 4 | 8 | 12 | 14 | 15 | 16 |
| M-P | NUMBER OF NON-DRIVING NOZZLES | 8 | 6 | 4 | 0 | 12 | 8 | 4 | 2 | 1 | 0 | 14 | 12 | 8 | 4 | 2 | 1 | 0 |
| C | BASE UNIT OF RESTRICTION PATTERN (LEAST COMMON MULTIPLE OF P AND M)/P | 2 | 8 | 4 | 1 | 4 | 2 | 4 | 8 | 16 | 1 | 8 | 4 | 2 | 4 | 8 | 16 | 1 |
| CONDITION | P×L>M | × | ○ | ○ | ○ | × | ○ | ○ | ○ | ○ | ○ | × | ○ | ○ | ○ | ○ | ○ | ○ |
| | P<M | ○ | ○ | ○ | × | ○ | ○ | ○ | ○ | ○ | × | ○ | ○ | ○ | ○ | ○ | ○ | × |
| | L≥2 | ○ | ○ | ○ | ○ | ○ | ○ | ○ | ○ | ○ | ○ | ○ | ○ | ○ | ○ | ○ | ○ | ○ |
| DETERMINATION | | × | ○ | ○ | × | × | ○ | ○ | ○ | ○ | × | × | ○ | ○ | ○ | ○ | ○ | × |
| NUMBER OF DOTS WHICH CAN BE PRINTED AT SAME ADDRESS | | 1 | 1or2 | 1or2 | 2 | 1 | 2 | 3 | 3or4 | 3or4 | 4 | 1 | 2 | 4 | 6 | 7 | 7or8 | 8 |
| AVERAGE VALUE OF NUMBERS OF DOTS WHICH CAN BE PRINTED AT SAME ADDRESS P×L/M | | 1 | 1.25 | 1.5 | 2 | 1 | 2 | 3 | 3.5 | 3.75 | 4 | 1 | 2 | 4 | 6 | 7 | 7.5 | 8 |

v iii i iv ii

PRINTING APPARATUS AND DRIVING CONTROL METHOD FOR PRINTHEAD

BACKGROUND OF THE INVENTION

Field of the Invention

The present invention relates to a printing apparatus and a driving control method for a printhead.

Description of the Related Art

In some printing apparatuses, a printhead includes two or more nozzle arrays which are used to print dots of the same color and each of which has a plurality of nozzles arranged along a predetermined direction. Print data are distributed to the respective nozzle arrays, and the respective nozzle arrays are simultaneously driven based on the distributed print data. This arrangement is advantageous in improving the print speed since the two or more nozzle arrays are parallelly driven to print dots according to the print data.

Japanese Patent Laid-Open No. 2012-30594 (e.g. FIG. 8C) discloses a technique in which the nozzles of each group of two nozzle arrays are time-divisionally driven, and each nozzle array is time-divisionally driven by shifting the driving timings by a ½ period of time-divisional driving. Similarly, Japanese Patent Laid-Open No. 2012-30594 (e.g. FIG. 11C) discloses a technique in which the nozzles of each group of four nozzle arrays are time-divisionally driven, and each nozzle array is time-divisionally driven by shifting the driving timings by a ¼ period of time-divisional driving.

In the arrangement described in Japanese Patent Laid-Open No. 2012-30594, however, only one of the plurality of nozzle arrays can execute printing in a region corresponding to the resolution of dot print data. Consequently, one dot is printed in the region corresponding to the resolution of the dot print data, thereby limiting a reproducible gamut.

SUMMARY OF THE INVENTION

The present invention has as its object to provide a printing apparatus and a driving control method for a printhead, which can reproduce a sufficient gamut by printing a plurality of dots in a region corresponding to the resolution of dot print data while suppressing a decrease in print speed.

One of the aspects of the present invention provides a printing apparatus including a printhead for printing on a printing medium, and a print control unit, the printhead including at least two nozzle arrays configured to print dots on the printing medium, having the same length, and arranged in a first direction, and each nozzle array including a plurality of nozzles arranged along a second direction intersecting the first direction, wherein the print control unit performs a first operation of expanding print data onto a memory in correspondence with the first direction and the second direction, a second operation of, in each nozzle array for every unit column data corresponding to the second direction in the print data expanded in the first operation, selecting some of the plurality of nozzles as non-driving nozzles so the nozzles do not overlap each other between the nozzle arrays in the first direction, and the remaining nozzles of the plurality of nozzles as driving nozzles, and a third operation of distributing the print data expanded in the first operation to the nozzle arrays so that printing of dots corresponding to each unit column data is completed by printing dots corresponding to the driving nozzles of each nozzle array selected in the second operation by the driving nozzles and printing dots corresponding to the non-driving nozzles of each nozzle array selected in the second operation by the driving nozzles of another nozzle array selected in the second operation.

Further features of the present invention will become apparent from the following description of exemplary embodiments with reference to the attached drawings.

BRIEF DESCRIPTION OF THE DRAWINGS

FIGS. 5A to 5C are views for explaining an example of a print data processing method;

FIGS. 7A to 7C are views for explaining an example of the print data processing method;

FIGS. 9A to 9C are views for explaining an example of a print data processing method;

FIG. 11 is a table for explaining an example of a reference table for determining priority levels;

FIGS. 14A to 14E are views for explaining an example of the print data processing method;

FIGS. 15A1, 15A2 and 15B are views for explaining an example of the print data processing method and examples of dots formed on a printing medium;

FIG. 16 is a view for explaining an example of a print data processing method.

DESCRIPTION OF THE EMBODIMENTS (Example of Arrangement of Printing Apparatus)

Figure 1:
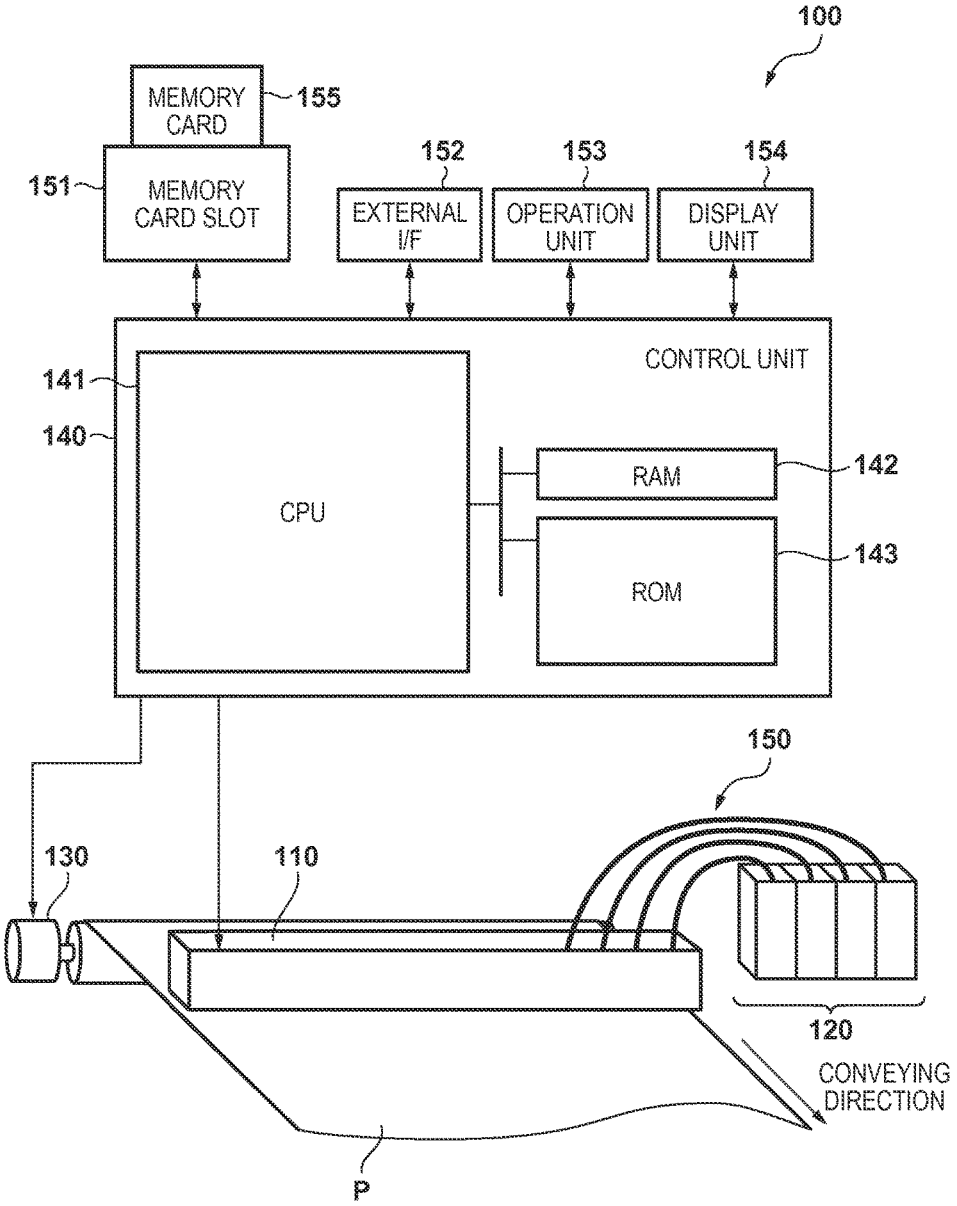
FIG. 1 is a view for explaining an example of the overall arrangement of a printing apparatus.

FIG. 1 is a schematic view for explaining an example of the overall arrangement of an inkjet printing apparatus 100 (to be also simply referred to as an "apparatus 100" hereinafter). The apparatus 100 includes a printhead 110 for printing on a printing medium P, ink cartridges 120 for supplying inks (printing agents) to the printhead 110, a conveying roller 130 for conveying the printing medium P, and a control unit 140.

A plurality of nozzles are arranged along a predetermined direction in the printhead 110, and ink dots (dots) are printed on the printing medium by discharging ink droplets from the nozzles. The printhead 110 adopts a so-called full-line arrangement, and can perform printing at the full width (for example, about 18 inches) on a sheet at once.

When the apparatus 100 supports color printing, the ink cartridges 120 are provided in correspondence with respective colors (for example, yellow (Y), magenta (M), cyan (C), and black (K)). In this example, the four ink cartridges 120 are provided. Ink in each ink cartridge 120 is supplied to the printhead 110 via, for example, an ink inlet pipe 150. Note that the color types and the number of colors are not limited to those in this example.

The conveying roller 130 conveys the printing medium P in a direction intersecting the array direction of the plurality of nozzles in the printhead 110. In this specification, the array direction of the nozzles will be simply referred to as a "nozzle array direction" hereinafter, and the conveying direction of the printing medium P will be simply referred to as a "conveying direction" hereinafter.

Note that only the conveying roller 130 is shown for the sake of simplicity. The apparatus 100 may further include other conveying units. For example, the apparatus 100 includes a paper feed unit for feeding the printing medium P to a path for executing printing on the printing medium P and each process associated with printing, a plurality of conveying rollers for conveying the printing medium P from the paper feed unit, and a plurality of motors for driving the plurality of conveying rollers.

The control unit 140 includes, for example, a CPU 141 and a memory such as a RAM 142 and ROM 143, and performs print control for printing on the printing medium P. The control unit 140 controls the respective units of the apparatus 100 based on, for example, a print job including a control command and print data. More specifically, for example, the CPU 141 reads out a program for printing from the ROM 143 and expands it onto the RAM 142, and also expands print data onto the RAM 142, thereby performing data processing based on the program for the print data. The CPU 141 drives the conveying roller 130 while driving the printhead 110 based on the print data having undergone the data processing.

Note that upon start of printing based on the print data having undergone the above data processing, before the printing is completed, preparations for printing based on next print data are started by expanding the next print data onto the RAM 142, and performing the same data processing. By repeating this operation, one or more images corresponding to a print job input to the apparatus 100 are formed on the printing medium P without interrupting a print operation.

With the above arrangement, while the printing medium P is conveyed in the conveying direction, dots are printed on the printing medium P by the respective nozzles of the printhead 110, and images, characters, and the like corresponding to the print data are formed on the printing medium P.

The apparatus 100 may further include a memory card slot 151, an external interface (external I/F) 152, an operation unit 153, and a display unit 154. These units are connected to the control unit 140 via, for example, a system bus, and can exchange print data or a control command. For example, a memory card 155 is inserted to the memory card slot 151, and the control unit 140 can read out print data held in the memory card 155, and perform control based on the print data. For example, the control unit 140 may receive print data via the external interface 152, and control each unit based on the print data. Furthermore, for example, the user can set print information via the operation unit 153, and the control unit 140 may control each unit based on the information. The display unit 154 can display a print status and the state of the apparatus 100, as needed, and the user can refer to the display unit 154.

Figure 2A:
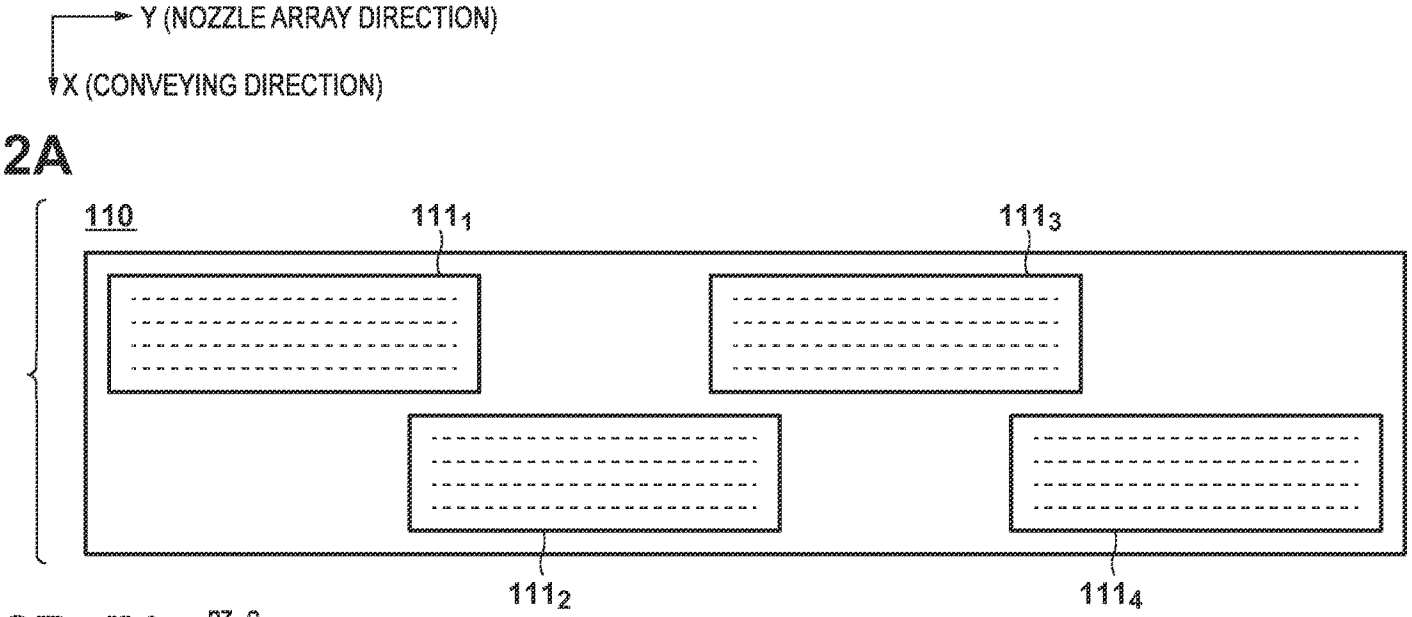
FIGS. 2A and 2B are views for explaining an example of the arrangement of a full-line printhead.
Figure 2B:
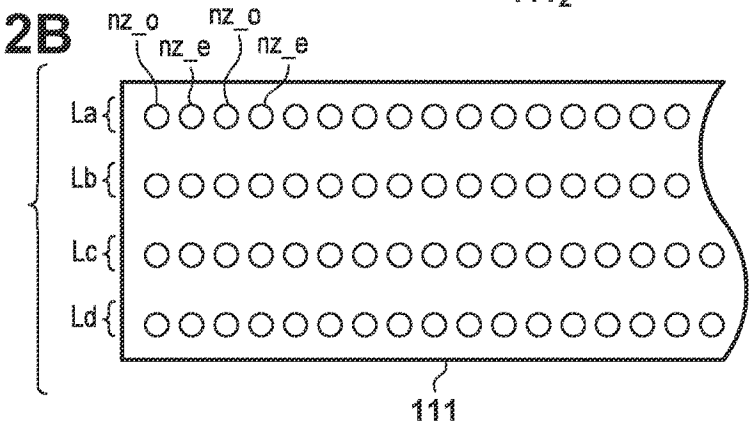

FIGS. 2A and 2B are schematic views for explaining a portion, corresponding to one color (for example, K), of an example of the arrangement of the printhead 110. As exemplified in FIG. 2A, a plurality of nozzle substrates 111 such as $\mathbf{111}_1$ are arranged in a staggered pattern on the surface of the printhead 110, which is used to perform printing. As exemplified in FIG. 2B, four nozzle arrays L, that is, La to Ld for printing dots of the same color (in this example, K) are provided in each nozzle substrate 111. Each nozzle array L includes a plurality of nozzles nz, that is, nz_o and nz_e arranged at predetermined pitches (for example, 1,200 dpi) in a direction intersecting the conveying direction of the printing medium P. Referring to FIGS. 2A and 2B, the conveying direction of the printing medium P is represented by "X" and the nozzle array direction is represented by "Y". The nozzles nz_o indicate odd-numbered nozzles (the first, third, and fifth nozzles, and the like) in the nozzle array direction Y, and the nozzles nz_e indicate even-numbered nozzles (the second, fourth, and sixth nozzles, and the like) in the nozzle array direction Y. The nozzles nz_o and nz_e may be arranged in line, as exemplified in FIG. 2A or may be arranged in a staggered pattern (not shown). This specification assumes that the nozzles nz_o and nz_e form one array in either case.

The full-line printhead 110 is formed to have such arrangement. Note that the number of nozzle arrays L and the number of nozzle substrates 111 are not limited to those in this example. Although the four nozzle arrays L have been exemplified for one color (K) for the sake of simplicity, the same applies to the remaining three colors (Y, M, and C).

Figure 3:
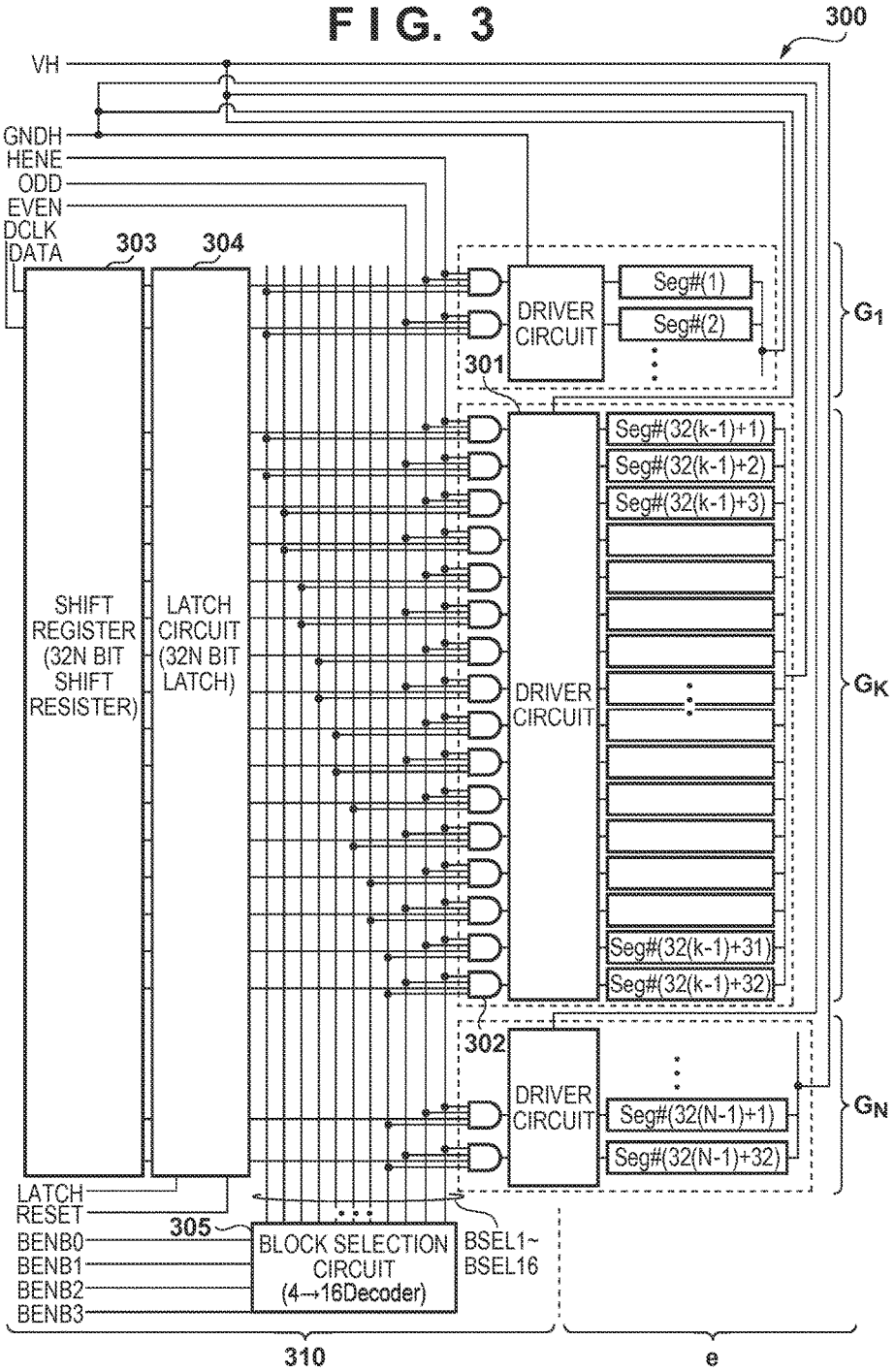
FIG. 3 is a view for explaining an example of the arrangement of a printing element substrate.

FIG. 3 shows an example of the arrangement of a printing element substrate 300 (to be simply referred to as an "element substrate 300" hereinafter). FIG. 3 exemplifies the arrangement of a portion corresponding to one (for example, the nozzle array La; the same applies to the remaining nozzle arrays Lb to Ld) of the four nozzle arrays L for the sake of simplicity. Note that the element substrate 300 may be provided for each nozzle substrate 111 to correspond to it.

The element substrate 300 includes a plurality of printing elements e and a logic circuit 310 for driving the plurality of printing elements e. Each of the plurality of printing elements e corresponds to each nozzle nz, and an electrothermal transducer (heater) can be used as each printing element e. The logic circuit 310 specifically includes driver circuits 301, AND circuits 302, a shift register 303, a latch circuit 304, and a block selection circuit 305. In accordance with a signal from the logic circuit 310, each printing element e is driven to generate heat energy, and the corresponding nozzle nz discharges an ink droplet by the heat energy. This is also expressed as "the nozzle is driven".

The plurality of printing elements e are divided into N groups G, that is, $G_1$ to $G_N$ so that each group includes 32 printing elements e (N is an integer of 2 or more). More specifically, a segment number (Seg#) is assigned to each of the plurality of printing elements e, and a given group $G_k$ includes 32 printing elements e of Seg#(32($k$−1)+1) to Seg#(32($k$−1)+32) (k is an integer of 1 to N).

Among the 32 printing elements e of the group $G_k$, 16 printing elements e of Seg#(32($k$−1)+1), Seg#(32($k$−1)+3), . . . , Seg#(32($k$−1)+31) correspond to the nozzles nz_o. Among the above 32 printing elements e, 16 printing elements e of Seg#(32($k$−1)+2), Seg#(32($k$−1)+4), . . . , Seg#(32($k$−1)+32) correspond to the nozzles nz_e. That is, among the 32 printing elements e of each group G, odd-numbered printing elements correspond to the nozzles nz_o and even-numbered printing elements correspond to the nozzles nz_e.

Whether the odd-numbered or even-numbered printing elements e are driven is selected using, for example selection signals ODD and EVEN. More specifically, the signals ODD and EVEN are at different signal levels (one signal is at high level (H) and the other signal is at low level (L)). If, for example, the signal ODD is at H level and the signal EVEN is at L level, the odd-numbered printing elements e are driven based on the print data. Alternatively, if the signal ODD is at L level and the signal EVEN is at H level, the even-numbered printing elements e are driven based on the print data. In the embodiment shown in the following as an example, the odd-numbered printing elements e and the even-numbered printing elements e are alternately driven based on the signal ODD and the signal EVEN. However, in another embodiment, the odd-numbered printing elements e and the even-numbered printing elements e may be driven at the same time, or may be driven individually (independently each other).

Furthermore, block numbers B#1 to B#16 are sequentially assigned to the 16 odd-numbered printing elements e. Similarly, the block numbers B#1 to B#16 are sequentially assigned to the 16 even-numbered printing elements e. For example, in the group $G_k$, the printing elements e of Seg#(32($k$−1)+1) and Seg#(32($k$−1)+2) are assigned with B#1. That is, B#1: Seg#(32($k$−1)+1) and Seg#(32($k$−1)+2)

Similarly,

B#2: Seg#(32($k$−1)+3) and Seg#(32($k$−1)+4)
B#3: Seg#(32($k$−1)+5) and Seg#(32($k$−1)+6)
B#4: Seg#(32($k$−1)+7) and Seg#(32($k$−1)+8)
B#5: Seg#(32($k$−1)+9) and Seg#(32($k$−1)+10)
B#6: Seg#(32($k$−1)+11) and Seg#(32($k$−1)+12)
B#7: Seg#(32($k$−1)+13) and Seg#(32($k$−1)+14)
B#8: Seg#(32($k$−1)+15) and Seg#(32($k$−1)+16)
B#9: Seg#(32($k$−1)+17) and Seg#(32($k$−1)+18)
B#10: Seg#(32($k$−1)+19) and Seg#(32($k$−1)+20)
B#11: Seg#(32($k$−1)+21) and Seg#(32($k$−1)+22)
B#12: Seg#(32($k$−1)+23) and Seg#(32($k$−1)+24)
B#13: Seg#(32($k$−1)+25) and Seg#(32($k$−1)+26)
B#14: Seg#(32($k$−1)+27) and Seg#(32($k$−1)+28)
B#15: Seg#(32($k$−1)+29) and Seg#(32($k$−1)+30)
B#16: Seg#(32($k$−1)+31) and Seg#(32($k$−1)+32)

Similarly, segment numbers (Seg#) and block numbers (B#) can be assigned to the corresponding nozzles nz, that is, nz_o and nz_e.

Each of the printing elements e of each group G is driven for each block together with the corresponding printing elements e of other groups G. More specifically, the respective printing elements e of the same block number are simultaneously driven. For example, the printing element e of Seg#(1) of the group $G_1$ and that of Seg#(32($k$−1)+1) of the group $G_k$ belong to the same block, that is, B#1, and are driven at substantially the same timing. The printing elements e belonging to the respective blocks are sequentially driven.

This driving method will also be referred to as "time-divisional driving" hereinafter, the block will also be referred to as a "time-divisional driving block" or simply a "time-divisional block" hereinafter, and the group will also be referred to as a "time-divisional driving group" or simply a "time-divisional group" hereinafter.

The shift register 303 is a 32×N-bit shift register, and sequentially shifts print data DATA every time a clock signal DCLK is received from the control unit 140.

The latch circuit 304 is a 32×N-bit latch circuit, and latches the 32×N-bit print data of the shift register 303 in response to a latch signal LATCH from the control unit 140. The latched data will also simply be referred to as "latch data" hereinafter. For example, the latch circuit 304 initializes the latch data upon receiving a reset signal RESET from the control unit 140.

The block selection circuit 305 functions as a decoder and, for example, generates a block selection signal BSEL, that is, BSEL1 to BSEL16 upon receiving block enable signals BENB0 to BENB3 from the control unit 140. The block selection signal BSEL is a control signal for selecting a specific block whose printing elements e are to be driven.

Each AND circuit 302 is provided in correspondence with each printing element e. Each AND circuit 302 receives the latch data of the latch circuit 304, the block selection signal BSEL, one of the selection signals ODD and EVEN, and a heat enable signal HENB for defining the driving time of the printing element e, and outputs a driving signal to the driver circuit 301.

A heater voltage VH and a ground voltage GNDH corresponding to it are supplied to the driver circuit 301, and the driver circuit 301 boosts the driving signal from the AND circuit 302 and supplies it to the printing element e. This drives the printing element e, that is, drives the corresponding nozzle nz to discharge an ink droplet.

Figure 4:
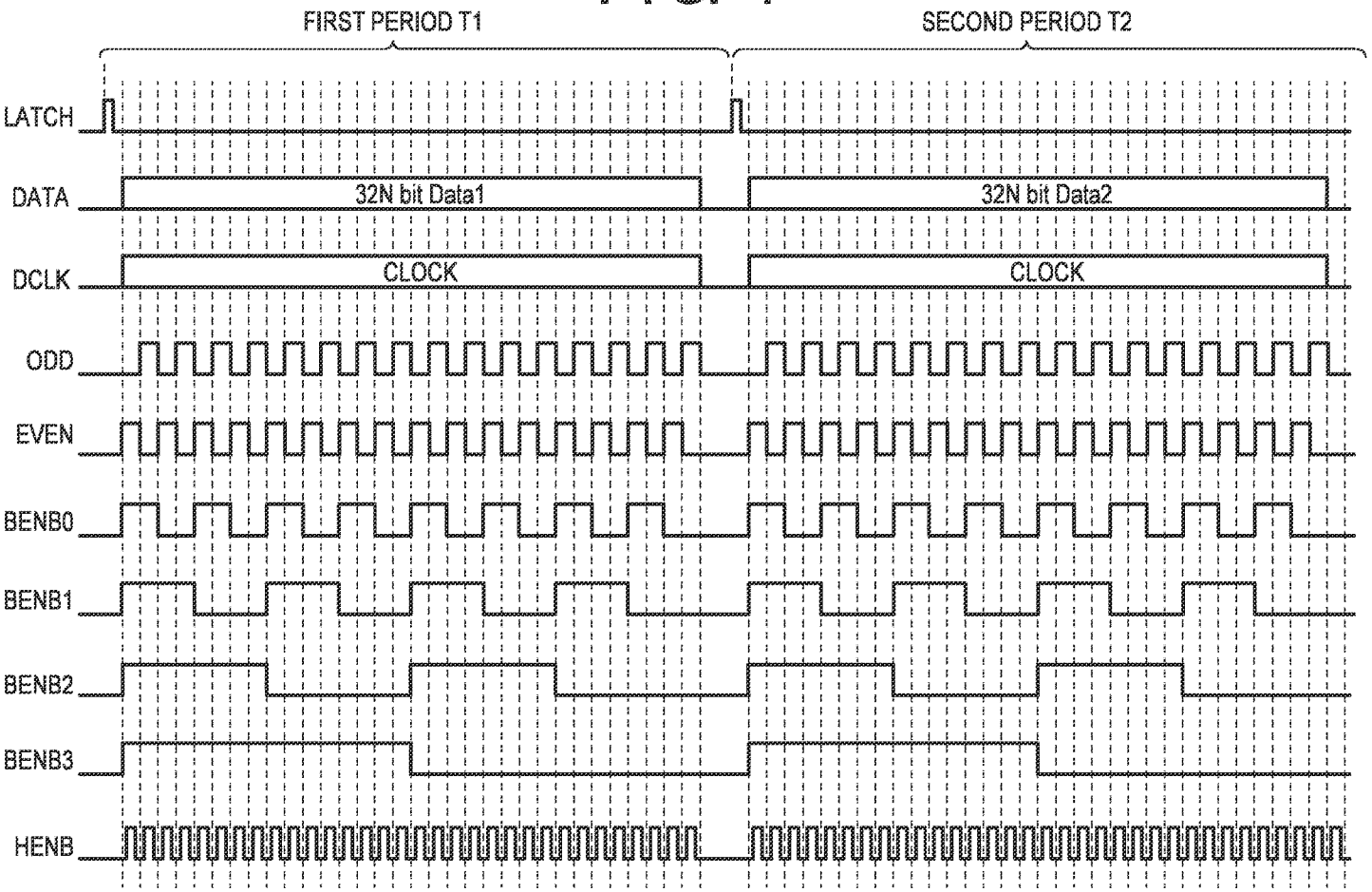
FIG. 4 is a timing chart for explaining an example of a driving method of the printing element substrate.

FIG. 4 shows a reference example of a timing chart for driving the element substrate 300. For example, during a first period T1, the latch signal LATCH is received, and the latch circuit 304 latches print data DATA1 corresponding to the period T1. After that, the block enable signal BENB0 is alternately set at H or L level in a predetermined cycle. During this period, the block enable signals BENB1 to BENB3 are alternately set at H or L level in cycles twice, four times, and eight times that of the signal BENB0, respectively. During the period T1, one of the 16 blocks, that is, B#1 to B#16 is sequentially selected. Furthermore, during this period, the selection signals ODD and EVEN are alternately set at H or L level in half the cycle of the signal BENB0 so that one of selection signals is set at H level and the other is set at L level. Each of the two printing elements e corresponding to one block selected by the signals BENB0 to BENB3 is individually selected. The selected printing element e is driven based on the print data DATA1.

Furthermore, during the period T1, the shift register 303 receives the clock signal DCLK, and shifts print data DATA2 for a second period T2. In response to the latch signal LATCH during the period T2, the latch circuit 304 latches the print data DATA2. After that, the same processing as that during the period T1 is performed.

First Embodiment

FIGS. 5A to 5C are views for explaining an example of a print data processing method according to the first embodiment. FIG. 5A is a flowchart illustrating an example of the print data processing method. FIG. 5B is a block diagram for explaining a data flow corresponding to the flowchart.

In step S110 (to be simply referred to as "S110" hereinafter; the same applies to other steps), print data input from a data input unit 510 are acquired. More specifically, as described with reference to FIG. 1, the print data can be externally input via an external interface 152 or the like, and expanded onto a RAM 142 of a control unit 140 or the like. The obtained print data are 8-bit, 256-tone data for three colors of red (R), green (G), and blue (B).

In S120, a color conversion processing unit 520 performs color conversion processing (color space conversion processing) for the input print data. The print data are converted into 8-bit, 256-tone data for respective colors corresponding to ink colors. For example, in this example in which color printing is executed using four ink colors of Y (yellow), M (magenta), C (cyan), and K (black), data for the four colors of Y, M, C, and K are generated. The print data having undergone the color conversion processing undergoes data processing for each color.

In S130, a quantization processing unit 530 performs quantization processing for the print data for each color, which has undergone the color conversion processing. The quantization processing includes data processing by, for example, an error diffusion method or dither matrix method. Assuming that unit data corresponding to a given print position is a "pixel value" in the print data, the error diffusion method performs quantization processing for each pixel value in accordance with the difference from its peripheral pixel value. The print data can be converted into, for example, four-level data (one of levels 0 to 3) by the error diffusion method.

FIG. 5C shows the number of dots corresponding to each level value for the print data converted into the four-level data (one of levels 0 to 3). Referring to FIG. 5C, if, among the print data, data corresponding to a given print position is at level 1 (Lv1), one dot is printed at the print position. If data corresponding to a given print position is at level 2 (Lv2), two dots are printed at the print position. If data corresponding to a given print position is at level 3 (Lv3), three dots are printed at the print position. Furthermore, if data corresponding to a given print position is at level 0 (Lv0), no dot is printed at the print position. With such arrangement in which two or more dots can be printed at the same print position, it is possible to increase the gamut of an image to be formed on a printing medium P. In addition, if print data undergoes quantization processing and is converted into multi-level data, it is possible to further increase the gamut of the image to be formed on the printing medium P.

In S140, a distribution processing unit 540 performs distribution processing for the print data for the respective colors, which have undergone the quantization processing, thereby distributing the print data to the respective nozzle arrays L of a printhead 110. More specifically, the print data are distributed to respective element substrates 300 so as to appropriately print dots by the corresponding nozzle arrays L.

The distribution processing unit 540 performs distribution processing based on a result of selection or determination by a selection/determination unit 535 and a detailed description thereof will be provided later. The selection/determination unit 535 selects, among a plurality of nozzles nz, nozzles (driving nozzles) which can be driven to perform printing according to the print data and nozzles (non-driving nozzles) which are not driven, and determines specific ones of the driving nozzles, which are to be used for printing.

Note that as described above with reference to FIG. 2A, each nozzle array L is formed by a plurality of nozzle substrates 111 arranged in a staggered pattern. Therefore, between the two nozzle substrates 111 adjacent to each other in the conveying direction, portions of the two chips overlap each other in the conveying direction. In this case, the print data need only be distributed so that dots are printed by one of the overlapping portions.

In S150, the printhead 110 is driven based on the distributed print data to print dots on the printing medium P by the respective nozzle arrays L.

Note that with respect to the above-described processing units 520 to 540, the control unit 140 may include dedicated arithmetic processing units corresponding to them or a CPU 141 may have functions corresponding to them.

Figure 6:
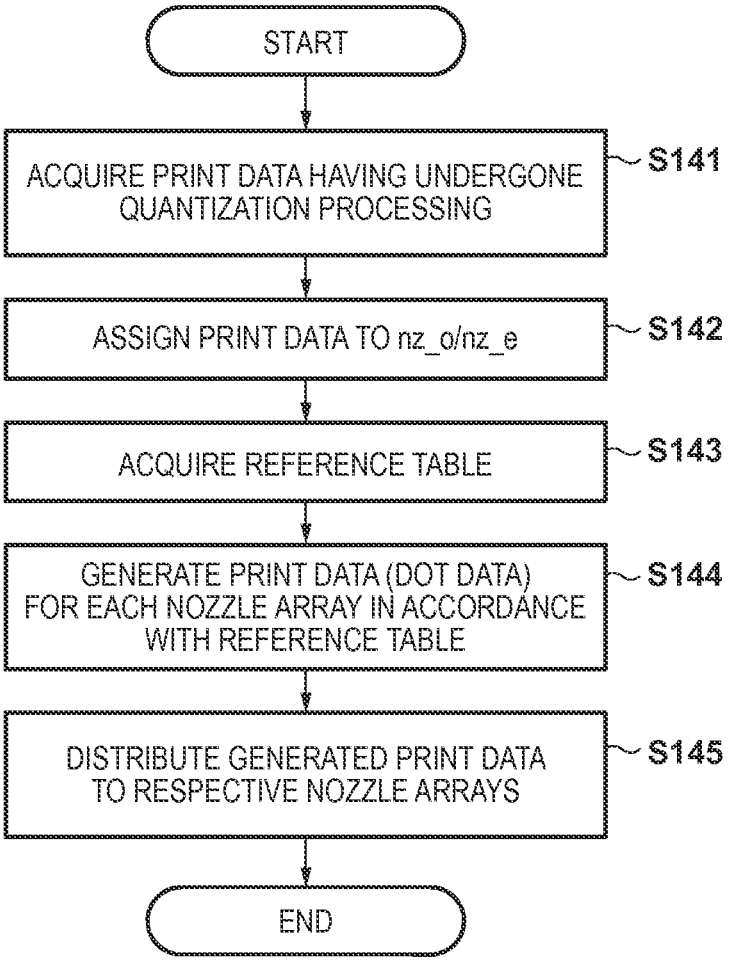
FIG. 6 is a flowchart for explaining an example of the print data processing method.

FIG. 6 is a flowchart for explaining details of the distribution processing in S140. In S141, the print data having undergone the quantization processing in S130 are acquired. In S142, the print data are assigned (divided) to correspond to nozzles nz_o and nz_e. In S143, a reference table for determining how the print data are distributed to the respective nozzle arrays is acquired. After that, in S144, print data for each nozzle array L is generated in accordance with the acquired reference table. Lastly, in S145, the generated print data are distributed to the respective nozzle arrays L. A practical example of the above flowchart will be described below with reference to FIGS. 7A to 7C, 8A, and 8B.

Note that a description will be provided by paying attention to the odd-numbered nozzles nz_o for the sake of simplicity. However, the same applies to the even-numbered nozzles nz_e.

Figure 7A:
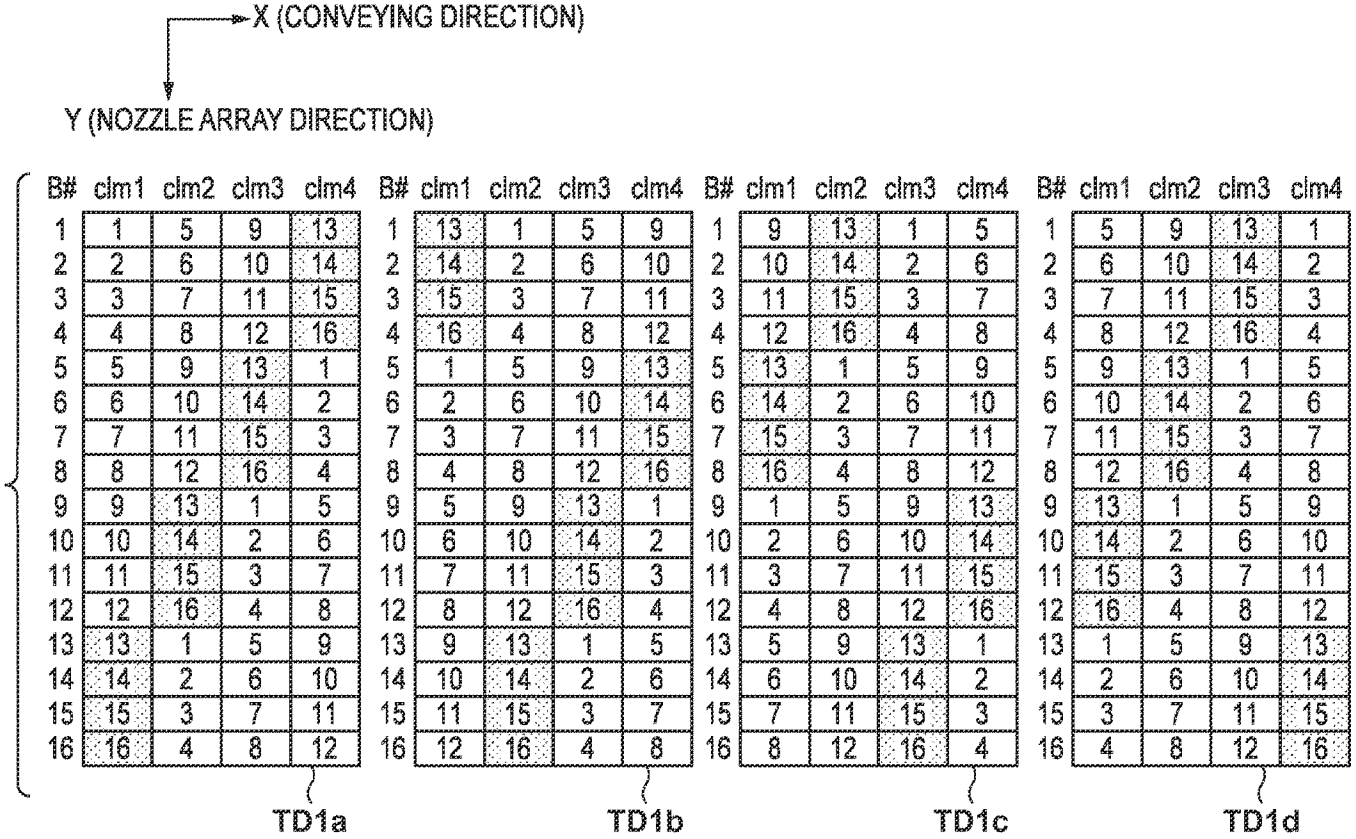

FIG. 7A exemplifies driving order reference tables TD1*a* to TD1*d* each for determining the driving order (block driving order) of the odd-numbered nozzles nz_o (B#1 to B#16) in a unit group G. The reference tables TD1*a* to TD1*d* are stored in advance in, for example, a ROM 143. A case in which the driving order of the driving nozzles complies with the order of the block numbers will be exemplified for the sake of simplicity.

Figure 7B:
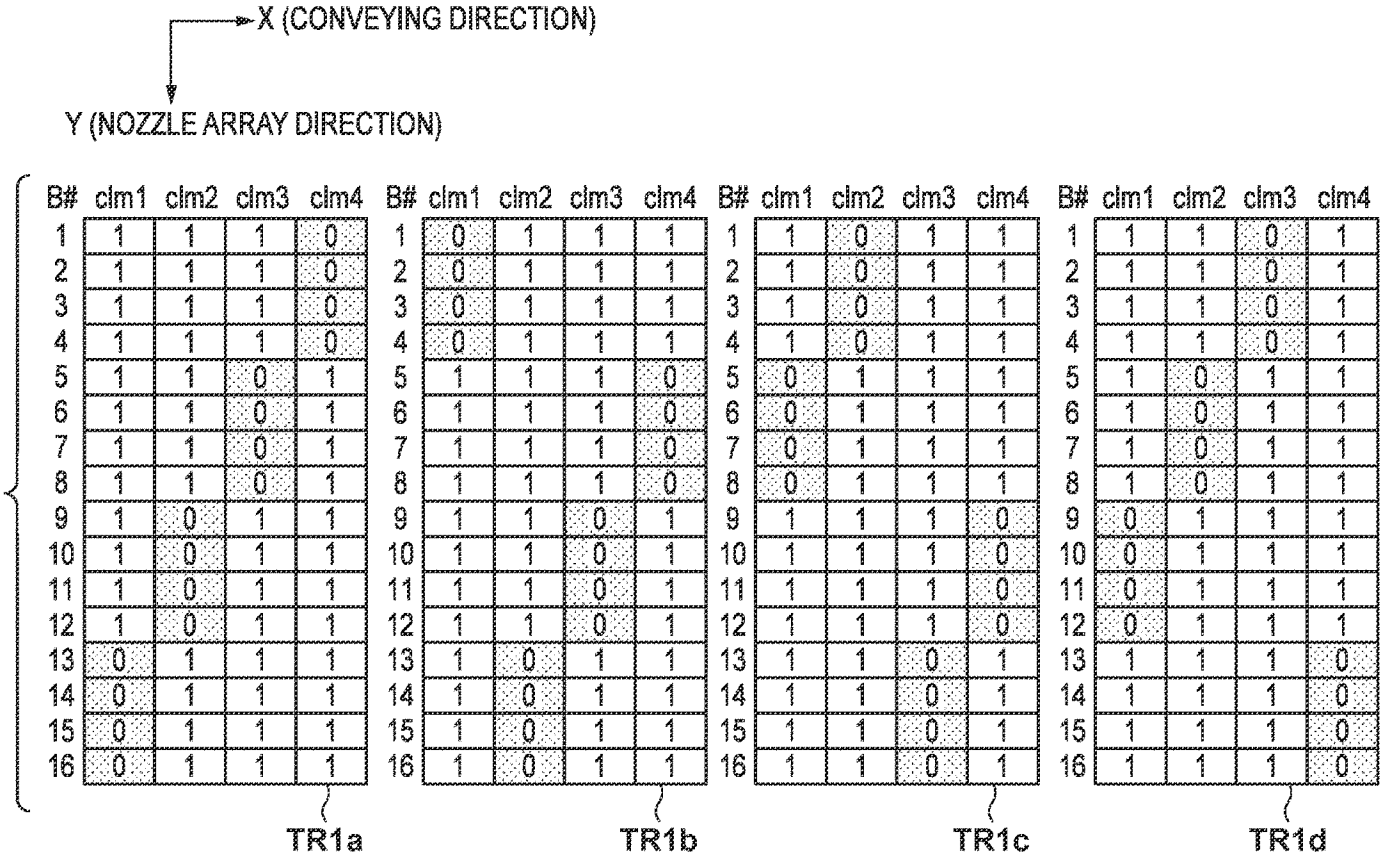

FIG. 7B is a view for explaining restriction patterns TR1*a* to TR1*d* each for defining driving nozzles and non-driving nozzles of the 16 nozzles nz_o. Driving nozzles and non-driving nozzles can be selected based on the driving order. In this example, a case in which among the 16 nozzles nz_o, the first to 12th nozzles in the driving order are selected as driving nozzles and the 13th to 16th nozzles are selected as non-driving nozzles will be exemplified.

Note that to discriminate between the driving nozzles and the non-driving nozzles, the boxes of the non-driving nozzles are hatched in FIGS. 7A and 7B.

Referring to FIGS. 7A and 7B, assume that on the printing medium P, a region where it is possible to print dots by driving all the driving nozzles once among the driving nozzles and non-driving nozzles is set as a "unit column". That is, assuming that the unit period of time-divisional driving is the time required to drive all the driving nozzles once, the unit column indicates a region where it is possible to print dots for one period of time-divisional driving, and can also indicate a region with a unit pixel width (for example, 1,200 dpi). Data for one column corresponding to the unit column in the print data will be referred to as "unit column data" or simply "column data" hereinafter. Each column data corresponds to the nozzle array direction Y.

Referring to FIGS. 7A and 7B, for example, in the driving order TD1*a* of the driving nozzles in a nozzle array La, the nozzles are driven in the order of B#1, B#2, . . . , B#12 with respect to a column clm1, and thus the nozzle array La prints dots for the column clm1. The nozzles are driven in the order of B#13, B#14, B#15, B#16, B#1, B#2, . . . , B#8 with respect to a column clm2, and thus the nozzle array La prints dots for the column clm2.

The phases of the cycles of the block driving orders defined in the driving order reference table are shifted by 90° between the respective nozzle arrays L. Therefore, for example, in a driving order TD1*b* of the driving nozzles in a nozzle array Lb, the nozzles are driven in the order of B#5, B#6, . . . , B#16 with respect to the column clm1, and thus the nozzle array Lb prints dots for the column clm1. The nozzles are driven in the order of B#1, B#2, . . . , B#12 with respect to the column clm2, and thus the nozzle array Lb prints dots for the column clm2. The same applies to the driving order TD1*c* of the driving nozzles in a nozzle array Lc, the driving order TD1*d* of the driving nozzles in a nozzle array Ld, and remaining columns clm3 and clm4.

Each restriction pattern defines driving nozzles and non-driving nozzles for every column unit. In other words, each restriction pattern is a reference table for selecting, for each column data of the print data, nozzles (that is, driving nozzles) which can be driven to print dots corresponding to the column data and nozzles (that is, non-driving nozzles) driving of which is limited. Each restriction pattern may be determined based on the driving order of the 16 nozzles nz_o in the unit group G and the number (12 in this example) of driving nozzles among the 16 nozzles, and need only be stored in, for example, the ROM 143 (see FIG. 1).

For example, with respect to the restriction pattern TR1*a* to be applied to the nozzle array La, in a first column clm1, the nozzles nz_o of B#1 to B#12 are driving nozzles and the nozzles nz_o of B#13 to B#16 are non-driving nozzles. Similarly, with respect to the restriction pattern TR1*b* to be applied to the nozzle array Lb, in the column clm1, the nozzles nz_o of B#5 to B#16 are driving nozzles and the nozzles nz_o of B#1 to B#4 are non-driving nozzles. With respect to the restriction pattern TR1*c* to be applied to the nozzle array Lc, in the column clm1, the nozzles nz_o of B#1 to B#4 and B#9 to B#16 are driving nozzles and the nozzles nz_o of B#5 to B#8 are non-driving nozzles. With respect to the restriction pattern TR1*d* to be applied to the nozzle array Ld, in the column clm1, the nozzles nz_o of B#1 to B#8 and B#13 to B#16 are driving nozzles and the nozzles nz_o of B#9 to B#12 are non-driving nozzles.

That is, some of the plurality of nozzles nz_o of each group G are selected as "non-driving nozzles" so the non-driving nozzles do not overlap each other between the nozzle arrays L in the conveying direction X, and the remaining nozzles are selected as "driving nozzles".

In this example, with respect to the column clm1, the nozzles nz_o of B#1 to B#4 in the nozzle array Lb are non-driving nozzles, and dots corresponding to these nozzles are printed by driving nozzles in at least one of the nozzle arrays La, Lc, and Ld. That is, in this example, with respect to the column clm1, dots corresponding to the nozzles nz_o of B#1 to B#4 are printed by the corresponding nozzles nz_o of at least one of the nozzle arrays La, Lc, and Ld.

Similarly, dots corresponding to the nozzles nz_o of B#5 to B#8 are printed by the corresponding nozzles nz_o of at least one of the nozzle arrays La, Lb, and Ld. Dots corresponding to the nozzles nz_o of B#9 to B#12 are printed by the corresponding nozzles nz_o of at least one of the nozzle arrays La, Lb, and Lc. Dots corresponding to the nozzles nz_o of B#13 to B#16 are printed by the corresponding nozzles nz_o of at least one of the nozzle arrays Lb, Lc, and Ld.

In the second column clm2, third column clm3, and fourth column clm4, the block numbers corresponding to the diving nozzles and non-driving nozzles are sequentially shifted by four. For example, with respect to the restriction pattern TR1*a*, the nozzles nz_o of B#9 to B#12 are non-driving nozzles in the column clm2, the nozzles nz_o of B#5 to B#8 are non-driving nozzles in the column clm3, and the nozzles nz_o of B#1 to B#4 are non-driving nozzles in the column clm4. The same applies to the restriction patterns TR1*b* to TR1*d*.

Although a description has been provided by paying attention to the odd-numbered nozzles nz_o for the sake of simplicity, the same applies to the even-numbered nozzles nz_e. An arrangement in which the driving order of the nozzles nz_o and that of the nozzles nz_e are the same is considered in this specification for the sake of simplicity but an arrangement in which these driving orders are different from each other can be adopted. If the driving orders are different from each other, selection of driving nozzles and non-driving nozzles from the nozzles nz_o and selection of driving nozzles and non-driving nozzles from the nozzles nz_e are independently performed based on the corresponding driving orders.

In summary, the "driving nozzles" are the nozzles nz which can be driven to perform printing according to the print data. Therefore, for example, if the corresponding latch data (see FIG. 3) is at H level, the driving nozzles are driven to print dots. On the other hand, if the latch data is at L level, the driving nozzles are not driven and no dots are printed. Furthermore, the "non-driving nozzles" selected by the restriction pattern are the nozzles nz driving of which is limited. The non-driving nozzles are not driven regardless of whether the latch data is at H or L level. Dots corresponding to the non-driving nozzles can be printed by the nozzles which correspond to the non-driving nozzles and are the driving nozzles in a nozzle array (for example, Lb to Ld) different from the nozzle array (for example, La) to which the non-driving nozzles belong. This completes printing of the dots corresponding to the print data.

Note that for example, if some nozzles nz_o (or some nozzles nz_e) are selected as driving nozzles, the remaining nozzles nz_o can be set as non-driving nozzles. Alternatively, if some nozzles nz_o are selected as non-driving nozzles, the remaining nozzles nz_o can be set as driving nozzles. That is, selection of driving nozzles and non-driving nozzles is substantially equivalent to selection of driving nozzles or non-driving nozzles.

FIG. 7C shows a priority level reference table TP1 for defining the priority level or priority order of driving of each driving nozzle. The table TP1 is a reference table for specifying a driving nozzle to be preferentially driven when printing one or more dots in a corresponding column by two or more driving nozzles having the same block number. The table TP1 can be determined based on, for example, the above-described restriction patterns TR1*a* to TR1*d*. For example, the table TP1 is referred to, based on the print data (four-level data of one of levels 0 to 3) which have undergone the quantization processing in S130, thereby determining a driving target from the selected driving nozzles.

For example, "cda" is defined for B#1 of the column clm1, which indicates that the nozzle array Lc has the highest priority, the nozzle array Ld has the second highest priority, and the nozzle array La has the lowest priority. For example, consider a case in which among the print data having undergone the quantization processing in S130, data corresponding to B#1 of the column clm1 is at level 1, that is, the number of dots to be printed is 1. In this case, one dot is printed at a print position corresponding to B#1 of the column clm1 by the nozzle nz of B#1 of the nozzle array Lc having the highest priority.

Furthermore, for example, "dac" is defined for B#2 of the column clm1, which indicates that the nozzle array Ld has the highest priority, the nozzle array La has the second highest priority, and the nozzle array Lc has the lowest priority. For example, consider a case in which among the print data having undergone the quantization processing in S130, data corresponding to B#2 of the column clm1 is at level 2, that is, the number of dots to be printed is 2. In this case, two dots are printed at a print position corresponding to B#2 of the column clm1 by the nozzle nz of B#2 of the nozzle array Ld having the highest priority and the nozzle nz of B#2 of the nozzle array La having the second highest priority.

Figure 8A:
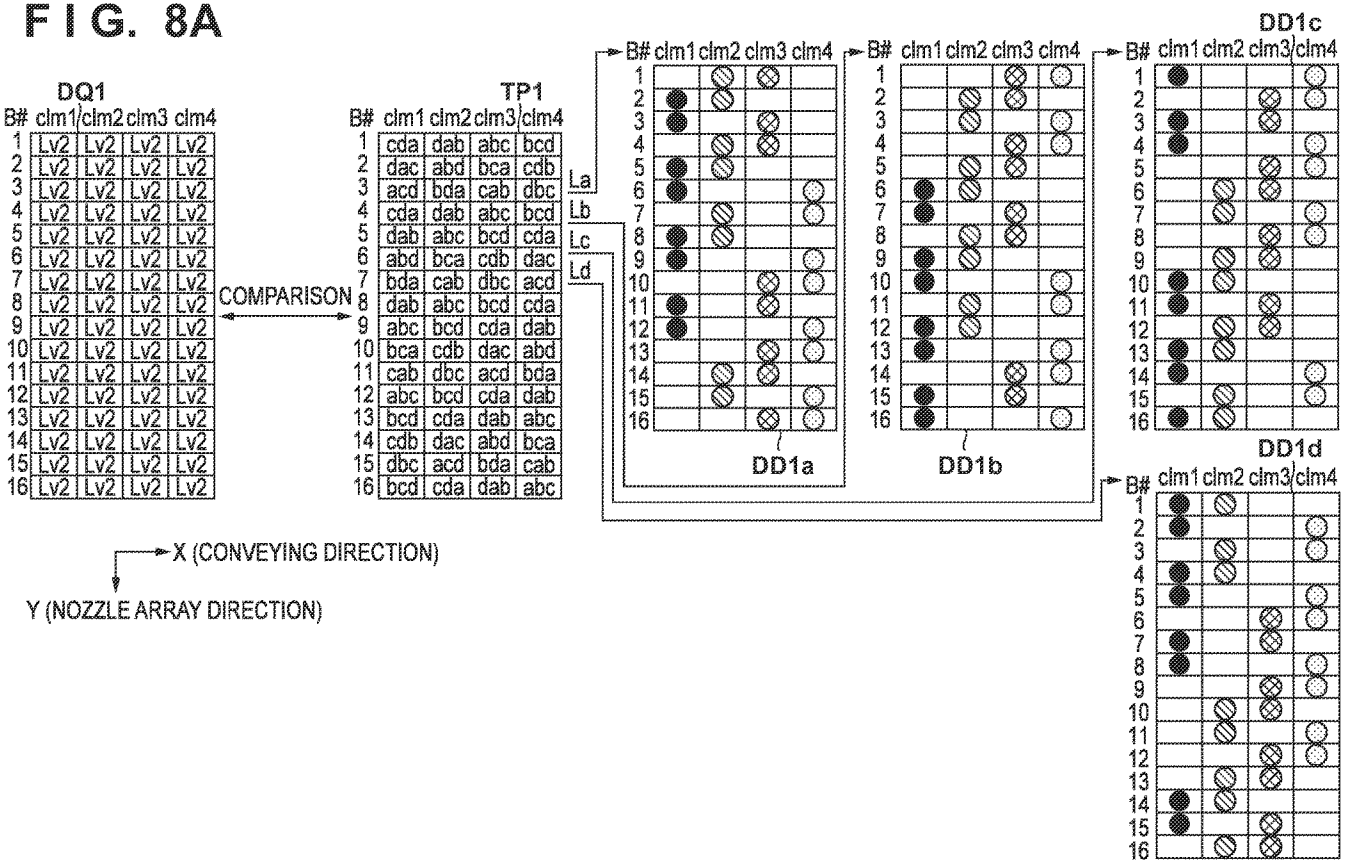
FIGS. 8A and 8B are views for explaining an example of the print data processing method and examples of dots formed on a printing medium.

FIG. 8A is a view for explaining an example of a method of distributing print data DQ1 having undergone the quantization processing in S130 to the respective nozzle arrays La to Ld with respect to, for example, the odd-numbered nozzles nz_o. For the sake of simplicity, consider a case in which data corresponding to each column and each block in the print data DQ1 is at level 2.

Print data DD1*a* to DD1*d* respectively distributed to the nozzle arrays La to Ld are dot data each indicating whether to print dots, and are generated based on the print data DQ1 and the above-described priority level reference table TP1. More specifically, the specific nozzle array L whose driving nozzle is to be used to print a dot corresponding to data corresponding to each column and each block in the print data DQ1 is determined based on the priority level of driving of each driving nozzle, thereby generating the print data DD1*a* to DD1*d*.

In this example, since the priority levels of B#1 of the column clm1 are indicated by "cda", dot data (indicated by a solid circle in FIG. 8A) is assigned to a portion corresponding to B#1 of the column clm1 of each of the print data DD1*c* and DD1*d*. Thus, two dots are printed at the print position corresponding to B#1 of the column clm1 by the driving nozzles of B#1 of the nozzle arrays Lc and Ld.

Similarly, since the priority levels of B#2 of the column clm1 are indicated by "dac", dot data (indicated by a solid circle in FIG. 8A) is assigned to a portion corresponding to B#2 of the column clm1 of each of the print data DD1*d* and DD1*a*. Thus, two dots are printed at the print position corresponding to B#2 of the column clm1 by the driving nozzles of B#2 of the nozzle arrays Ld and La. The same applies to the remaining block numbers B#3 to B#16 and the remaining columns clm2 to clm4.

The thus generated print data DD1*a* to DD1*d* are distributed to the corresponding nozzle arrays La to Ld, respectively. Note that the same applies to the odd-numbered nozzles nz_o and the even-numbered nozzles nz_e.

Figure 8B:
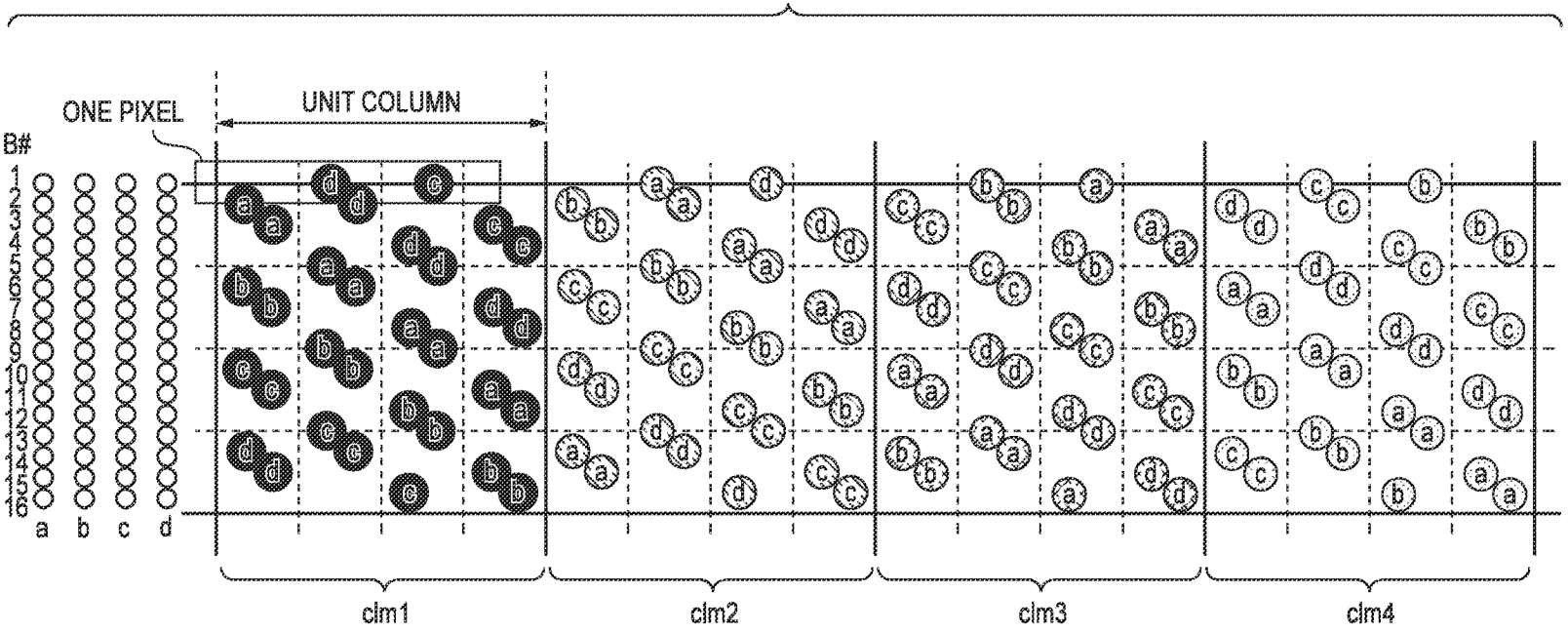

FIG. 8B is a view for explaining dots on the printing medium P, which have been printed by the nozzle array La and the like based on the distributed print data DD1*a* and the like. The driving nozzles of the nozzle array La and the like are sequentially driven according to the driving order TD1*a* and the like described with reference to FIG. 7B, and print dots based on the distributed print data DD1*a* and the like. As described above, in each column corresponding to 1,200 dpi, a dot is printed by each nozzle nz_o selected as a driving nozzle in the column data corresponding to the column.

Note that for the sake of simplicity, a symbol is assigned to each dot in FIG. 8B so as to recognize one of the nozzle arrays La to Ld whose driving nozzle has printed the dot. For example, a dot with "a" is a dot printed by the driving nozzle of the nozzle array La. The same applies to "b" to "d".

For example, in the column clm1, the nozzles nz_o of B#13 to B#16 of the nozzle array La are non-driving nozzles. Dots corresponding to B#13 to B#16 are printed by the nozzles nz_o of B#13 to B#16 which are driving nozzles in the nozzle arrays Lb to Ld other than the nozzle array La. Similarly, in the column clm2, the nozzles nz_o of B#9 to B#12 of the nozzle array La are non-driving nozzles, and dots corresponding to B#9 to B#12 are printed by the nozzles nz_o of B#9 to B#12 which are driving nozzles in the remaining nozzle arrays Lb to Ld.

Note that a description has been provided by paying attention to the odd-numbered nozzles nz_o but the same applies to the even-numbered nozzles nz_e.

According to this embodiment, as for each column data, some of the plurality of nozzles nz, that is, nz_o and nz_e of each nozzle array L are selected as non-driving nozzles, and the remaining nozzles nz are selected as driving nozzles. The non-driving nozzles are selected so the non-driving nozzles do not overlap each other between the nozzle arrays L in the conveying direction X of the printing medium P. That is, a dot (a dot which is not printed by a non-driving nozzle) corresponding to a non-driving nozzle of a given nozzle array (for example, the nozzle array La) is printed by a driving nozzle of another nozzle array (for example, one of the nozzle arrays Lb to Ld), thereby completing printing of dots corresponding to the print data.

According to this embodiment, some of the plurality of nozzles nz are selected as non-driving nozzles and their driving is limited, and dots corresponding to the non-driving nozzles are printed by driving nozzles of another nozzle array different from a nozzle array to which the non-driving nozzles belong. Consequently, according to this embodiment, it is possible to appropriately print all dots in the corresponding columns without changing the operation speed of each nozzle array L. It is also possible to print a plurality of dots at the same address by selecting nozzles to be used from nozzle arrays which can print at the address (that is, a plurality of nozzle arrays whose nozzle corresponding to the address is a driving nozzle) and distributing the data to the nozzles. This can represent, in a wider gamut, an image to be formed. Furthermore, the driving nozzles and non-driving nozzles are shifted for each column data (in other words, the nozzles nz which serve as non-driving nozzles for given column data are driven as driving nozzles for the next column data), thereby effectively using all the plurality of nozzles nz.

Note that a case in which the data processing of the print data for four columns is performed has been exemplified in this embodiment for the sake of simplicity but the same applies to a fifth column clm5 and subsequent columns. The above-described data processing may be repeatedly performed for every four columns. For example, a portion of the restriction pattern TR1*a* or the like, which corresponds to the column clm1, need only be applied to the column clm(4×i+1) where i is an integer of 1 or more. Similarly, portions of the priority level reference table TP1, which correspond to the columns clm2, clm3, and clm4, need only be applied to the columns clm(4×i+2), clm(4×i+3), and clm(4×i+4), respectively.

Although the printhead 110 including the four nozzle arrays La to Ld has been exemplified in this embodiment, the number of nozzle arrays is not limited to this and need only be two or more. For example, when the printhead 110 includes L nozzle arrays and each group G includes M nozzles nz where L represents an integer of 2 or more and M represents an integer of 2 or more and a multiple of L, M/L nozzles nz may be selected as non-driving nozzles. In this example, a number P of driving nozzles in each group G is given by P=M−M/L.

Although the full-line printhead 110 has been exemplified in this embodiment, the same applies to a serial printhead for performing printing by alternately repeating scanning of the printhead and conveyance of the printing medium.

Second Embodiment

A case in which the block driving order complies with the order of the block numbers has been exemplified in the above-described first embodiment for the sake of simplicity. The present invention, however, is not limited to this, and other block driving orders may be adopted. In the second embodiment, the block driving order is mainly different from that in the first embodiment. More specifically, the block driving order is not the order of block numbers, and complies with shuffled block numbers. Such driving method will also be referred to as "distributed driving" hereinafter. According to this embodiment, it is also possible to obtain the same effects as those in the first embodiment.

Figure 9A:
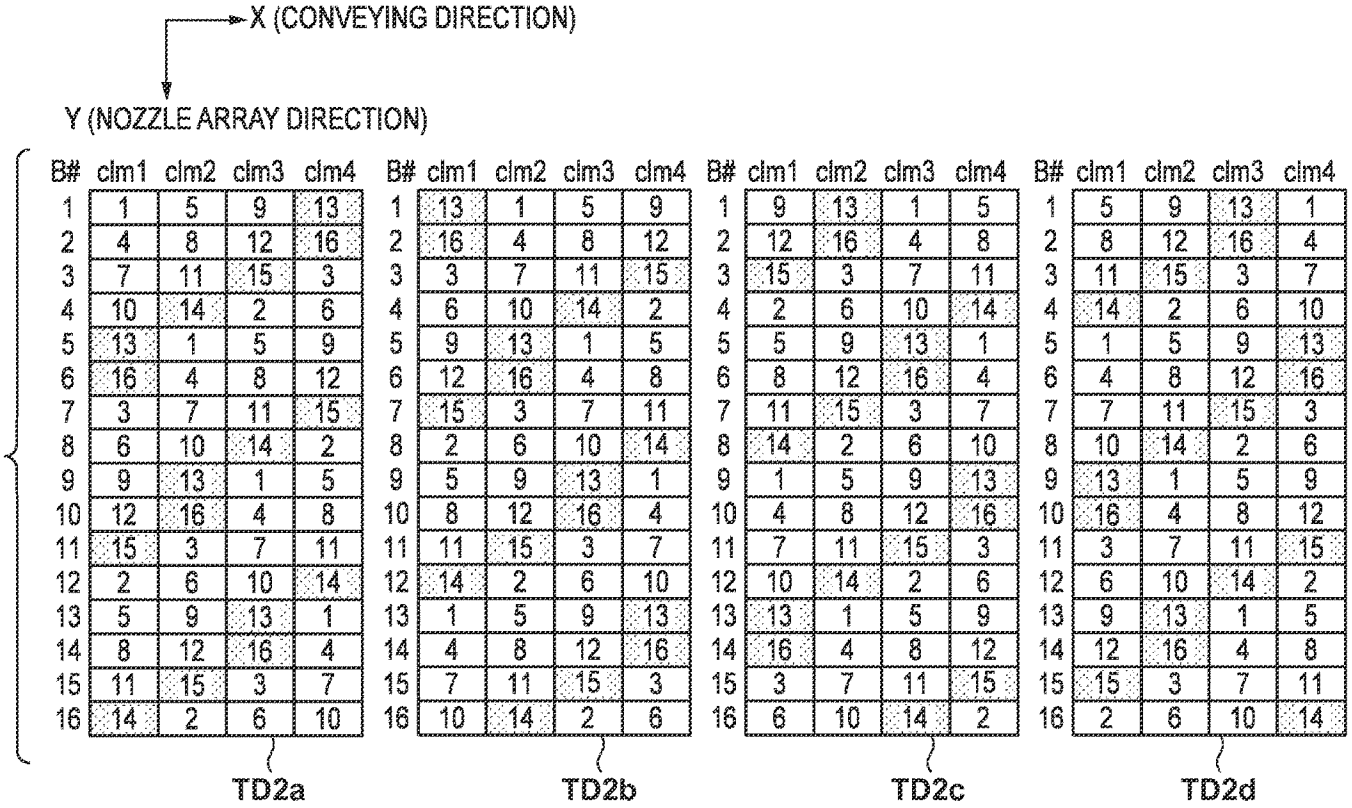
Figure 9B:
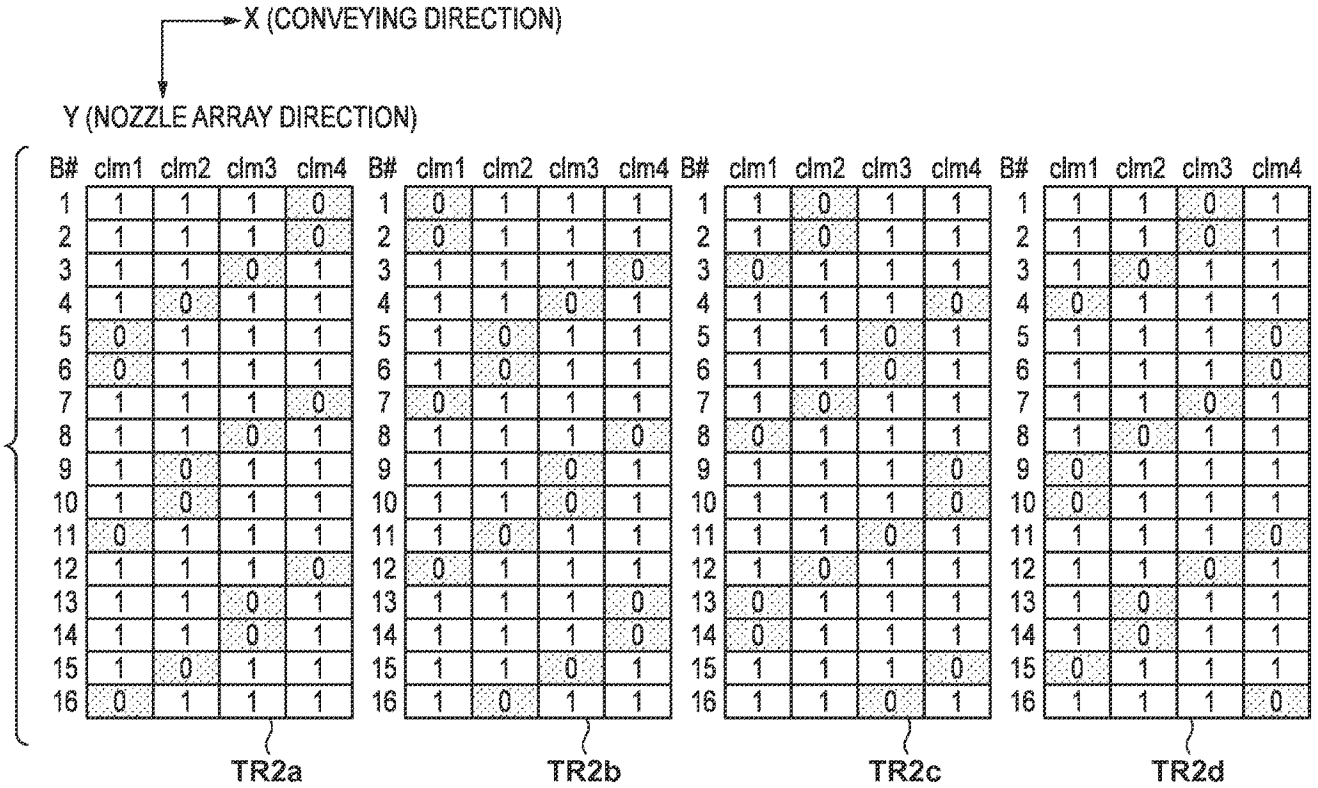

FIG. 9A shows driving orders TD2*a* to TD2*d* according to this embodiment, similarly to FIG. 7A in the first embodiment. FIG. 9B shows restriction patterns TR2*a* to TR2*d* corresponding to the driving orders TD2*a* to TD2*d*, similarly to FIG. 7B in the first embodiment. FIG. 9C shows a priority level reference table TP2 according to this embodiment, similarly to FIG. 7C in the first embodiment.

In this embodiment, for example, according to the driving order TD2*a*, with respect to a column clm1 of a nozzle array La, nozzles nz_o (or nozzles nz_e) are driven in the order of B#1, B#12, B#7, B#2, B#13, B#8, B#3, B#14, B#9, B#4, B#15, B#10, B#5, B#16, B#11, and B#6. According to the corresponding restriction pattern TR2*a*, in the column clm1 of the nozzle array La, nozzles nz of B#5, B#6, B#11, and B#16 are non-driving nozzles and the remaining nozzles nz are driving nozzles. In a second column clm2 and subsequent columns, the block numbers corresponding to the diving nozzles and non-driving nozzles and corresponding driving orders are shifted by four. Similarly to FIG. 7A in the first embodiment, the phases of the cycles of the block driving orders are shifted by 90° between nozzle arrays L.

Figure 10A:
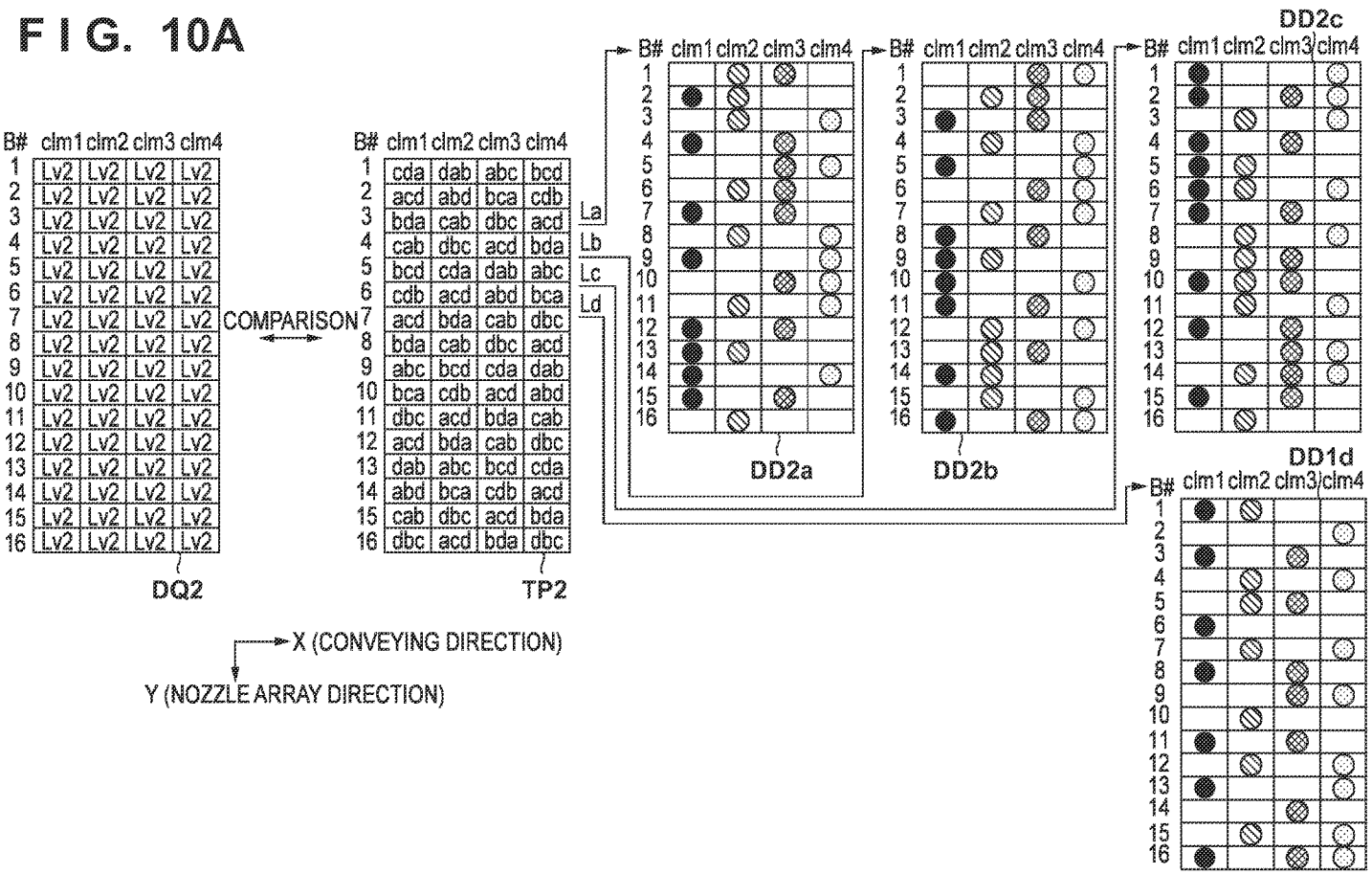
FIGS. 10A and 10B are views for explaining an example of the print data processing method and examples of dots formed on a printing medium.
Figure 10B:
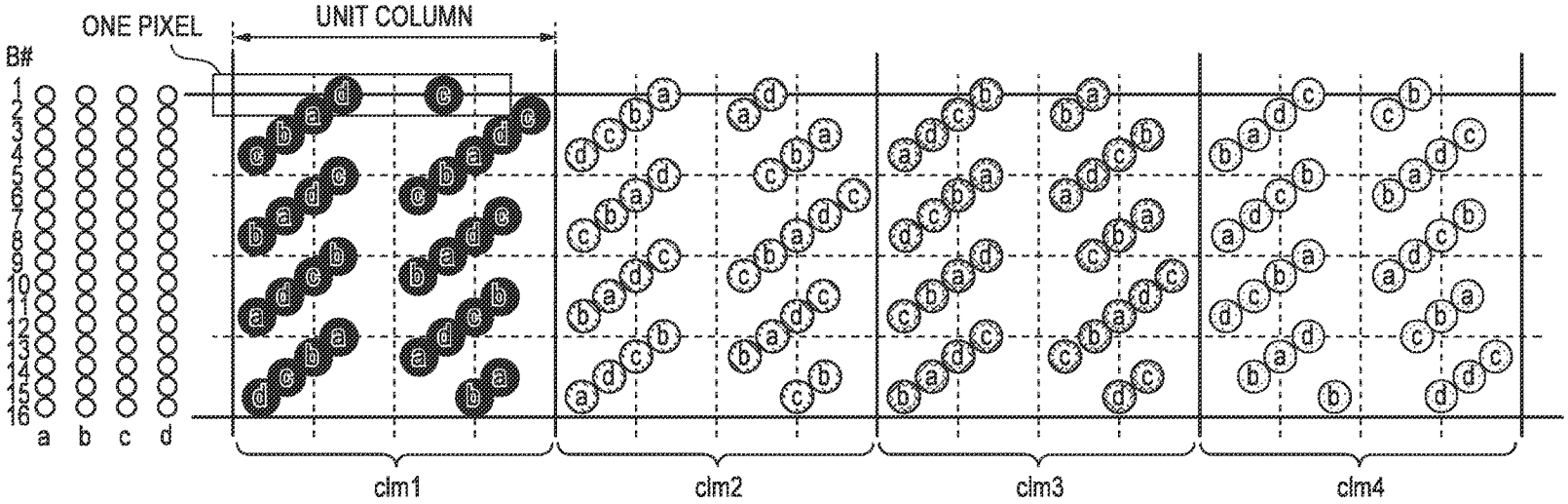

FIG. 10A shows an example of a method of distributing print data DQ2 having undergone quantization processing to respective nozzle arrays La to Ld, similarly to FIG. 8A in the first embodiment. According to the same procedure as in the first embodiment, print data DD2*a* to DD2*d* are generated based on the print data DQ2 and the priority level reference table TP2, and distributed to the nozzle arrays La to Ld, respectively. FIG. 10B shows dots on a printing medium P, which have been printed by the nozzle array La and the like based on the distributed print data DD2*a* and the like, similarly to FIG. 8B in the first embodiment. The driving nozzles of the nozzle array La and the like are sequentially driven according to the driving order TD2*a* and the like, and print dots based on the distributed print data DD2*a* and the like.

Distributed driving is advantageous in an inkjet method since the influence of meniscus oscillation, caused by driving of the nozzle nz_o (or nozzle nz_e) of a given block, on the nozzle nz of an adjacent block is reduced. Note that an example of the driving order of distributed driving has been exemplified but the driving order is not limited to this, and may be changed for, for example, every predetermined period or every predetermined cycle.

Third Embodiment

In the above-described first embodiment, a case has been exemplified in which the data processing for the column clm5 and subsequent columns is repeatedly performed for every four columns (the same data processing is repeatedly performed for each minimum unit of four columns), similarly to the columns clm1 to clm4. However, the present invention is not limited to this, and each reference table may be changed for every predetermined cycle. The third embodiment is mainly different from the first embodiment in that the priority levels or priority orders of driving of driving nozzles defined in a priority level reference table are shuffled for every four columns. According to this embodiment, it is also possible to obtain the same effects as those in the first embodiment and the like.

FIG. 11 shows a priority level reference table TP3 according to this embodiment, similarly to FIG. 7C in the first embodiment. Columns clm1 to clm4 of the table TP3 are the same as those of the above-described table TP1. On the other hand, with respect to columns clm5 to clm8 of the table TP3, priority levels defined in each column and each block are shuffled. With respect to columns clm9 to clm12, the priority levels are further shuffled.

More specifically, the priority levels of B#1 of the column clm1 are indicated by "cda" but the priority levels of B#1 of the column clm5 are indicated by "dac", which means that the priority levels have been shuffled. Furthermore, the priority levels of B#1 of the column clm9 are indicated by "acd", which means that the priority levels have been further shuffled. Similarly, the priority levels of B#1 of the column clm2 are indicated by "dab" but the priority levels of B#1 of the column clm6 are indicated by "abd", which means that the priority levels have been shuffled. Furthermore, the priority levels of B#1 of the column clm10 are indicated by "bda", which means that the priority levels have been further shuffled.

Figure 12:
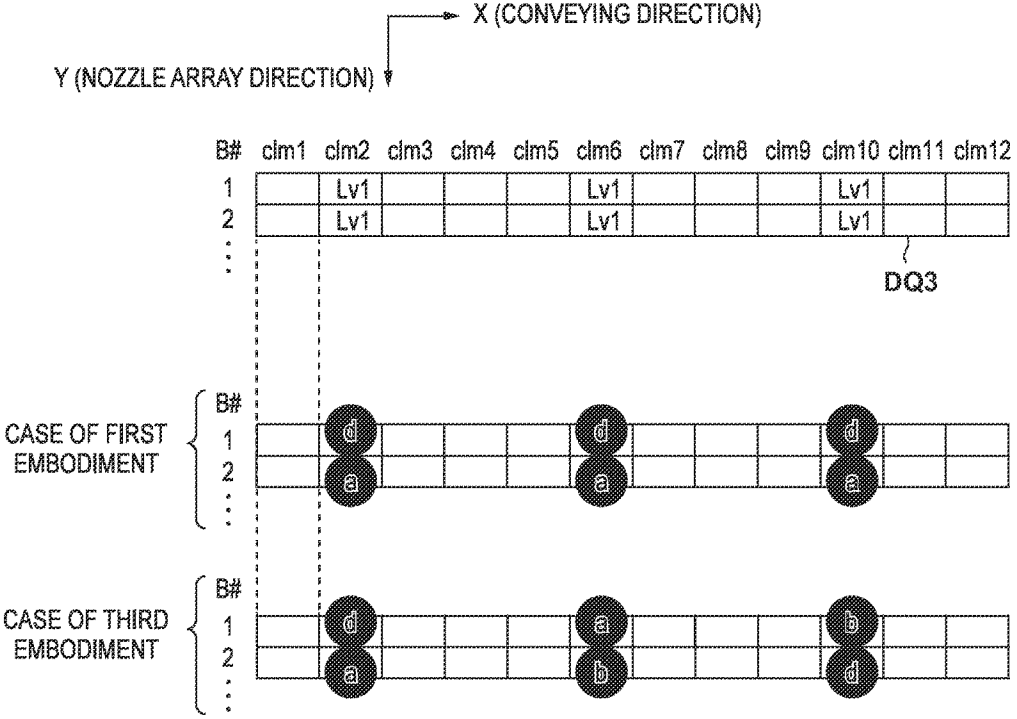
FIG. 12 is a view for explaining examples of dots formed on a printing medium.

FIG. 12 shows print data DQ3 having undergone quantization processing and corresponding dots on a printing medium P according to this embodiment. For the sake of simplicity, FIG. 12 shows part of the print data and some of the dots, more specifically, portions corresponding to the columns clm2, clm6, and clm10 and block numbers B#1 and B#2. For the sake of simplicity, consider a case in which data corresponding to the columns clm2, clm6, and clm10 and the block numbers B#1 and B#2 in the print data DQ3 are at level 1 (the number of dots to be printed is one).

In this case, with respect to the columns clm2, clm6, and clm10 corresponding to B#1, in the case of the first embodiment, dots (indicated by d in FIG. 12) are printed in the columns by the nozzle array Ld. To the contrary, in the case of this embodiment, while a dot is printed in the column clm2 by a nozzle array Ld, a dot (indicated by a in FIG. 12) is printed in the column clm6 by a nozzle array La, and a dot (indicated by b in FIG. 12) is printed in the column clm10 by a nozzle array Lb.

With respect to the columns clm2, clm6, and clm10 corresponding to B#2, in the case of the first embodiment, dots are printed in the columns by the nozzle array La. To the contrary, in the case of this embodiment, while a dot is printed in the column clm2 by the nozzle array La, a dot is printed in the column clm6 by the nozzle array Lb and a dot is printed in the column com10 by the nozzle array Ld.

According to this embodiment, since nozzles to be used, among driving nozzles, are changed for every predetermined number of columns, it is possible to reduce a deviation in usage rate or use amount between nozzles nz_o (or nozzles nz_e). Note that a case in which the priority levels are shuffled for every predetermined number of columns has been exemplified but the priority levels may be shuffled for every predetermined period or every predetermined cycle.

Fourth Embodiment

A case in which the print data is converted into four-level data by quantization processing performed for each region of a unit column and unit block (1,200 dpi×1,200 dpi) has been exemplified in the above first embodiment. However, the present invention is not limited to this, and is applicable to a case in which printing is executed based on print data of various formats, such as a case in which multi-level data for each of other regions is used. In the fourth embodiment, for example, print data is converted into five-level data (one of levels 0 to 4) by performing quantization processing for each region corresponding to 600 dpi×600 dpi. That is, a quantization resolution in this embodiment is different from that in the first embodiment. Note that 600 dpi×600 dpi corresponds to two columns and two nozzles. More specifically, the two nozzles are the odd-numbered nozzle nz_o and even-numbered nozzle nz_e which are adjacent to each other. In this embodiment, the region of 600 dpi×600 dpi will also simply be referred to as a "unit region" hereinafter.

Figure 13:
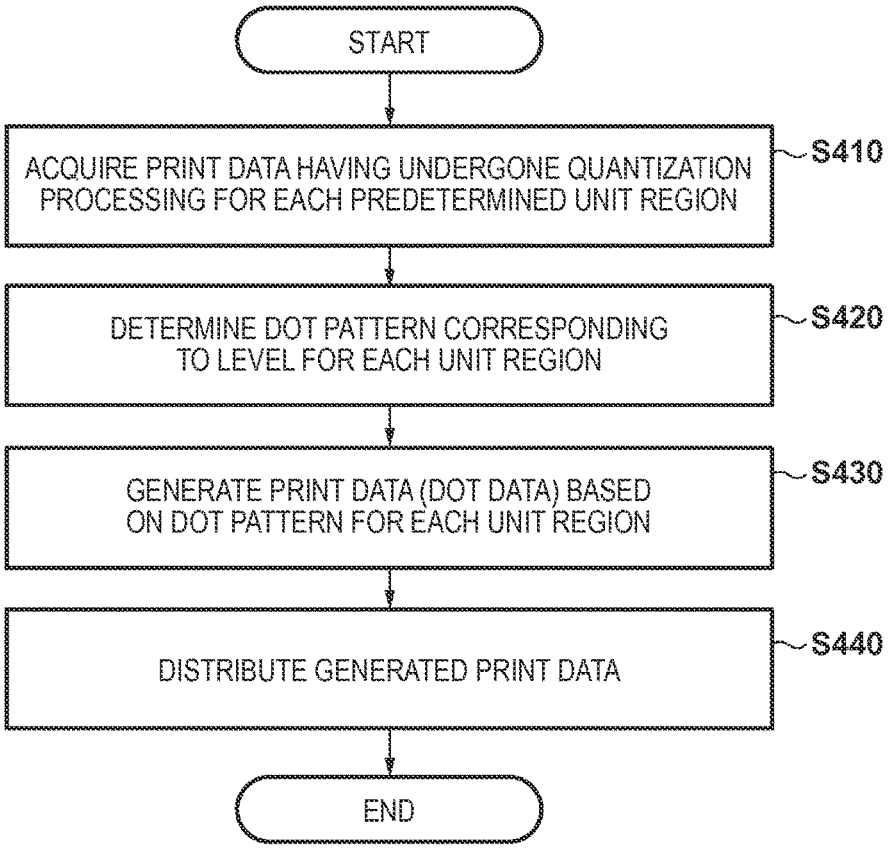
FIG. 13 is a flowchart for explaining an example of a print data processing method.

FIG. 13 is a flowchart for explaining details of distribution processing according to this embodiment. In S410, print data having undergone quantization processing for each unit region is acquired. In S420, for each unit region, a dot pattern corresponding to the level value of the unit region is determined based on the print data having undergone the quantization processing. After that, in S430, based on the determined dot pattern, print data (dot data) for each nozzle array L is generated. Lastly, in S440, the generated print data are distributed to the respective nozzle arrays L. A practical example of the above flowchart will be described with reference to FIGS. 14A to 14E, 15A1, 15A2, and 15B.

FIG. 14A shows the number of dots corresponding to each level value with respect to the five-level data (levels of 0 to 4). Referring to FIG. 14A, if, among the print data having undergone the quantization processing, data of a given unit region is at level 1, two dots are printed at print positions (600 dpi×600 dpi) corresponding to the unit region. Furthermore, for example, if data of a given unit region is at level 2, 3, or 4, four, six, or eight dots are printed at print positions corresponding to the unit region. If data of a given unit region is at level 0, no dots are printed at print positions corresponding to the unit region.

FIG. 14B shows print position determination tables TD41 to TD44 each for determining a dot pattern corresponding to a level value for each unit region with respect to the print data having undergone the quantization processing and corresponding print positions. The table TD41 and the like are provided for respective unit regions with respect to the levels 1 to 4. That is, the table TD41 corresponds to level 1, the table TD42 corresponds to level 2, the table TD43 corresponds to level 3, and the table TD44 corresponds to level 4. The table TD41 and the like are stored in, for example, a ROM 143 (see FIG. 1), and can be expanded onto a RAM 142, as needed. Note that if data is at level 0, no dot is printed, and thus no print position determination table need be prepared.

In the print position determination table TD41 or the like, dot pattern numbers (to be also simply referred to as "pattern numbers" hereinafter) are defined in correspondence with each corresponding unit region.

FIG. 14C is a view for explaining the dot pattern numbers defined in the print position determination table TD41 or the like and the corresponding dot patterns. For example, a dot pattern in which a dot is printed at the upper left print position of the unit region of 600 dpi×600 dpi is assigned to a pattern number Pat#1. Furthermore, for example, a dot pattern in which a dot is printed at each of the upper left print position and lower right print position of the unit region is assigned to a pattern number Pat#A. Among pattern numbers Pat#0 to Pat#9 and Pat#A to Pat#F, the pattern numbers Pat#1 and Pat#A have been explained. The same applies to the remaining pattern numbers.

Figure 14D:
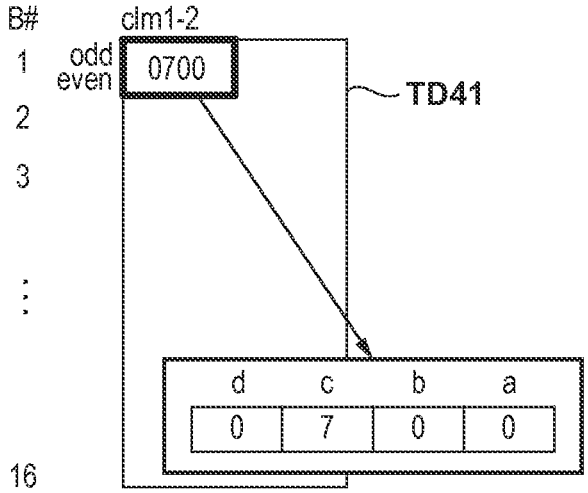

FIG. 14D is a view for explaining dot pattern numbers corresponding to a unit region of a column clm1-2 and B#1 (both the nozzles nz_o and nz_e) in the print position determination table TD41 corresponding to level 1, as an example. The dot pattern numbers of the column clm1-2 and B#1 are indicated by "0700". The four digits correspond to nozzle arrays Ld, Lc, Lb, and La, respectively, and indicate the pattern number Pat#0 and the like described with reference to FIG. 14C. That is, the dot pattern numbers "0700" indicate that Pat#0 is applied to the nozzle arrays La, Lb, and Ld and Pat#7 is applied to the nozzle array Lc.

Figure 14E:
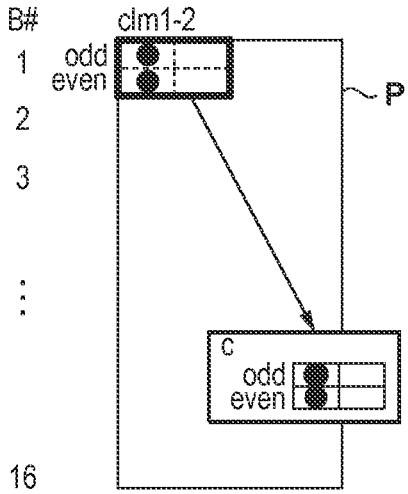

FIG. 14E is a view for explaining the print positions of dots on the printing medium P, which correspond to the dot pattern numbers "0700". Since Pat#0 is applied to the nozzle arrays La, Lb, and Ld, the nozzle arrays La, Lb, and Ld print no dots at the print positions corresponding to the column clm1-2 and B#1. On the other hand, Pat#7 is applied to the nozzle array Lc. The nozzle array Lc prints a dot at each of the upper left print position (the print position corresponding to the odd-numbered nozzle nz_o of the column clm1 and B#1) and the lower left print position (the print position corresponding to the even-numbered nozzle nz_e of the column clm1 and B#1) of the corresponding unit region. Consequently, the two dots in total corresponding to level 1 are printed at the print positions corresponding to the column clm1-2 and B#1.

That is, in this embodiment, a dot pattern corresponding to a level value for each unit region and corresponding print positions are determined with reference to the print position determination table TD41 or the like. In other words, specific ones of the nozzle arrays La to Ld which print dots corresponding to the print data having undergone the quantization processing at specific print positions are determined based on the print position determination table TD41 and the like.

The above print position determination table TD41 and the like can be determined based on the number of nozzle arrays L, the number of blocks in a unit group G, the number of driving nozzles (the number of non-driving nozzles), the block driving order, a restriction pattern TR1*a* and the like, and a priority level reference table TP1. From another viewpoint, in this embodiment, the above-described driving nozzles and non-driving nozzles can be defined by the print position determination table TD41 and the like.

FIGS. 15A1 and 15A2 are views for explaining an example of a method of distributing print data DQ4 having undergone quantization processing to the respective nozzle arrays La to Ld. For the sake of simplicity, in consideration of a case in which all data for respective unit regions of the print data DQ4 are at level 4, a portion corresponding to the column clm1-2 will be described.

With reference to the print position determination table TD41 and the like based on the print data DQ4, dot pattern numbers corresponding to the level value for each unit region are read out.

Since a case in which all the data for the respective unit regions of the print data DQ4 are at level 4 is considered, it is only necessary to refer to the print position determination table TD44. In this example, the pattern numbers in the column clm1-2 are:

"F708" for B#1;
"708F" for B#2;
"A18C" for B#3;
"D74A" for B#4;
"729E" for B#5; and
"9E72" for B#6.

Pattern numbers are set for B#7 and subsequent block numbers in the same manner. For example, "7878" for B#15, and "8F70" for B#16.

Based on the readout pattern numbers, a dot pattern for each unit region and corresponding print positions are determined, thereby generating print data DD4*a* to DD4*d* (dot data) to be distributed to the respective nozzle arrays L.

For example, the pattern numbers of the column clm1-2 and B#1 are indicated by "F708". Therefore, Pat#8 is applied to the nozzle array La, Pat#0 is applied to the nozzle array Lb, Pat#7 is applied to the nozzle array Lc, and Pat#F is applied to the nozzle array Ld.

Since Pat#8 is applied to the nozzle array La, data for printing dots at two print positions corresponding to the upper right and lower right positions in the corresponding unit region is generated. More specifically, data for printing dots at two print positions of the nozzle nz_o of the column clm2 and B#1 and the nozzle nz_e of the column clm2 and B#1 is generated. This data forms part of the print data DD4*a*. FIG. 15A1 separately shows data (DD4*a*_o) corresponding to the odd-numbered nozzle nz_o and data (DD4*a*_e) corresponding to the even-numbered nozzle nz_e for the sake of simplicity.

Since Pat#0 is applied to the nozzle array Lb, the nozzle array Lb prints no dots at print positions corresponding to the column clm1-2 and B#1. Since Pat#7 is applied to the nozzle array Lc, data for printing dots at two print positions, that is, the upper left and lower left positions (the nozzles nz_o and nz_e of the column clm1 and B#1) in the corresponding unit region is generated. Since Pat#F is applied to the nozzle array Ld, data for printing dots at four print positions, that is, the upper left, lower left, upper right, and lower right positions (the nozzles nz_o an nz_e of the column clm1 and B#1 and the nozzles nz_o and nz_e of the column clm2 and B#1) in the corresponding unit region is generated.

Note that according to the generated four data, the eight dots in total corresponding to level 4 are printed by the respective nozzle arrays La to Ld in the region of 600 dpi×600 dpi corresponding to the column clm1-2 and B#1. The same applies to the block number B#2 and subsequent block numbers and a column clm3-4 and subsequent columns.

The thus generated print data DD4*a* to DD4*d* are distributed to the nozzle arrays L, respectively.

Figure 15B:
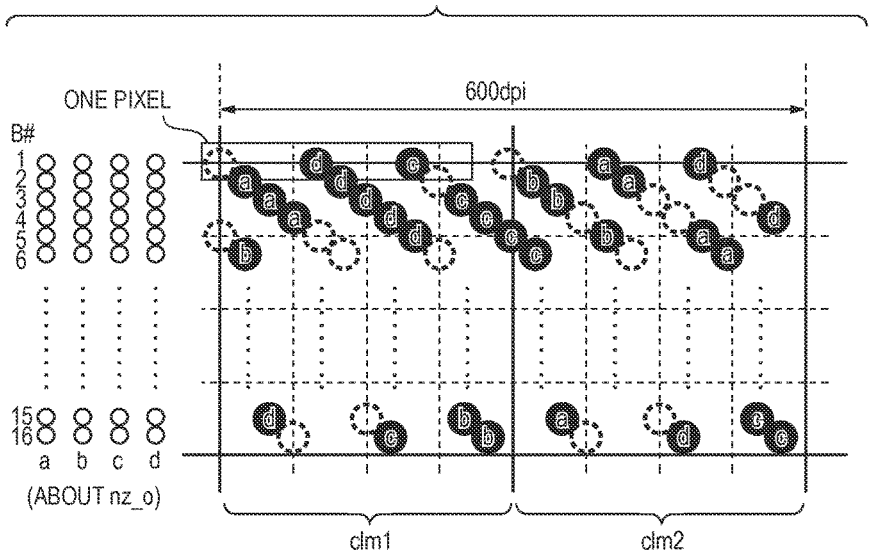

FIG. 15B exemplifies dots on the printing medium P, which have been printed by the odd-numbered nozzles nz_o of the nozzle array La and the like based on the distributed print data DD4*a* and the like, similarly to FIG. 8B in the first embodiment. Driving nozzles of the nozzle array La and the like are sequentially driven according to the driving order TD1*a* and the like, and print dots based on the distributed print data DD4*a* and the like. Although the result of printing by the odd-numbered nozzles nz_o has been exemplified, the same applies to the even-numbered nozzles nz_e.

As exemplified in this embodiment, the present invention is applicable to a case in which printing is executed based on print data of various formats. According to this embodiment, it is also possible to obtain the same effects as those in the above-described first embodiment.

Fifth Embodiment

In the above-described first embodiment, a case has been exemplified in which the number P of driving nozzles of each group G is given by P=M−M/L where L (an integer of 2 or more) represents the number of nozzle arrays and M (an integer of 2 or more) represents the number of blocks (that is, the number of nozzles nz_o (or the number of nozzles nz_e) of each group G). That is, in the first embodiment, each of the blocks of B#1 to B#16 is selected as a non-driving nozzle in one of the nozzle arrays La to Ld for each column data. However, the number P of driving nozzles is not uniquely determined based on the number L of nozzle arrays and the number M of blocks, and it is only necessary to satisfy a relationship of P×L>M and P<M (that is, M/L<P<M)

FIG. 16 shows cases when the number M of blocks is set to 16 and the number P of driving nozzles is an arbitrary integer not larger than M for the number L of nozzle arrays=2, 4, or 8, and other cases. For example, in FIG. 16, an example (i) shows the case of the first embodiment. That is, in an example (i), L=4, M=16, and P=12 (the number of non-driving nozzles is given by M−P=4).

In the above-described third embodiment, the minimum unit in which the priority levels of driving of the driving nozzles can be shuffled has been exemplified. If the minimum unit is represented by C, C is a value obtained by dividing the least common multiple of P and M by P. In the example (i), C=4. Note that the minimum unit C is also the minimum unit of a repetition period of the restriction pattern TR1*a* or the like, and may be referred to as "the base unit of the restriction pattern" hereinafter.

FIG. 16 shows whether each of conditions of P×L>M, P<M, and L≥2 is satisfied in addition to the parameters L, M, P, M−P, and C. With respect to each condition, if the condition is satisfied, "○" is shown; otherwise, "x" is shown. As for an example which satisfies all the conditions, "○" is set in a determination box. As for an example which does not satisfy at least one of the conditions, "x" is set in the determination box.

FIG. 16 shows the number of dots which can be printed at the same print position (to be also referred to as the "same address" hereinafter), and the average value of the numbers of dots for each example. In the example (i), the number and the average value correspond to the case of level 3 described with reference to FIG. 5C, and are thus 3.

In FIG. 16, the example (ii) is the first reference example, and shows a case in which L=4, M=16, and P=16 (the number of non-driving nozzles is given by M−P=0). This example indicates a case in which printing is executed using all the nozzles nz_o (or nozzles nz_e) without providing any non-driving nozzle, driving of none of the nozzles nz_o is limited, and an arbitrary dot may be printed by the nozzle nz_o of any of the nozzle arrays L. Therefore, the number of dots which can be printed at the same print position is four (equal to the number L of nozzle arrays).

In FIG. 16, an example (iii) is the second reference example, and indicates a case in which L=4, M=16, and P=4 (the number of non-driving nozzles is given by M−P=12). This example corresponds to the case shown in FIG. 11C of Japanese Patent Laid-Open No. 2012-30594 exemplified as a related art. That is, an arbitrary dot corresponds to a nozzle (driving nozzle) of one of nozzle arrays La to Ld, and print data corresponding to the dot is distributed to the nozzle array L to which the corresponding nozzle belongs. The number of dots which can be printed at the same print position is one.

By comparing the above examples (i) to (iii), the print speed in the example (i) corresponding to the first embodiment is higher than that in the example (ii) under the condition of the same operation frequency, and the gamut of an image to be formed on the printing medium P in the example (i) is larger than that in the example (iii). From another viewpoint, this indicates that the example (i) achieves the print performance between the examples (ii) and (iii).

Figure 17A:
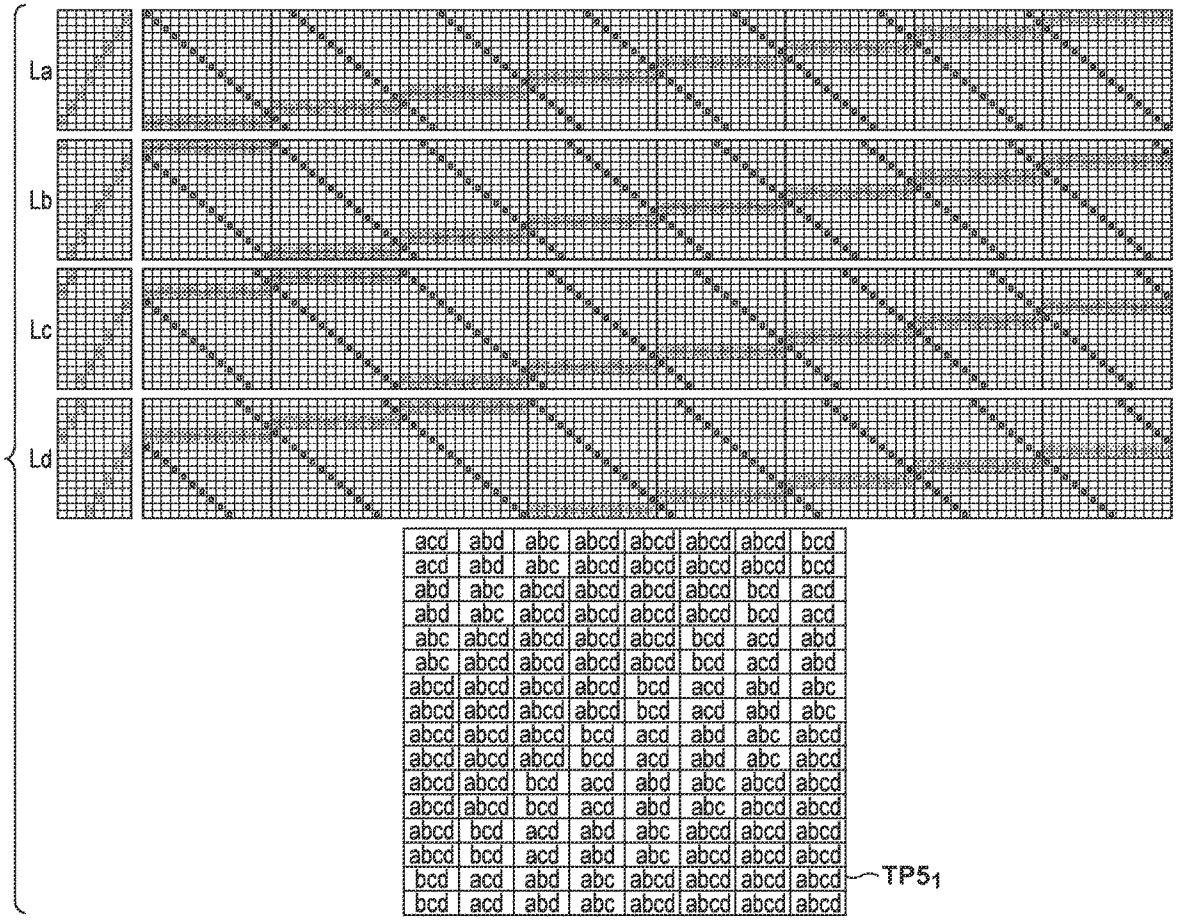
FIGS. 17A and 17B are views for explaining an example of the print data processing method.

FIG. 17A shows restriction patterns corresponding to an example (iv) shown in FIG. 16, that is, a case in which L=4, M=16, and P=14 (the number of non-driving nozzles is given by M−P=2), dots printed on the printing medium P in the example (iv), and a table TP$\mathbf{5}_1$ in which nozzle arrays capable of printing dots at the same position are described.

In the example (iv), the number (M−P) of non-driving nozzles is smaller than M/L. Therefore, each of the blocks B#1 to B#16 may serve as a non-driving nozzle in one of the nozzle arrays La to Ld, or may never serve as a non-driving nozzle in any of the nozzle arrays La to Ld. In the former case, it is only necessary to print dots at the same print position by driving nozzles of the corresponding nozzles nz_o (or nozzles nz_e), and the number of dots which can be printed at the same print position is three. In the latter case, dots may be printed at the same print position by the nozzles nz_o (or nozzles nz_e) of any of the nozzle arrays La to Ld, and the number of dots which can be printed at the same print position is four. The average value of the numbers of dots which can be printed at the same print position is 3.5.

By comparing the examples (i), (ii), and (iv), the print speed in the example (iv) is higher than that in the example (ii) under the condition of the same operation frequency, and the gamut of an image to be formed on the printing medium P in the example (iv) is larger than that in the example (i). From another viewpoint, this indicates that the example (iv) achieves the print performance between the examples (i) and (ii).

Although a case in which the number of nozzle arrays is L=4 has been described above, the same applies to different numbers (for example, L=2).

Figure 17B:
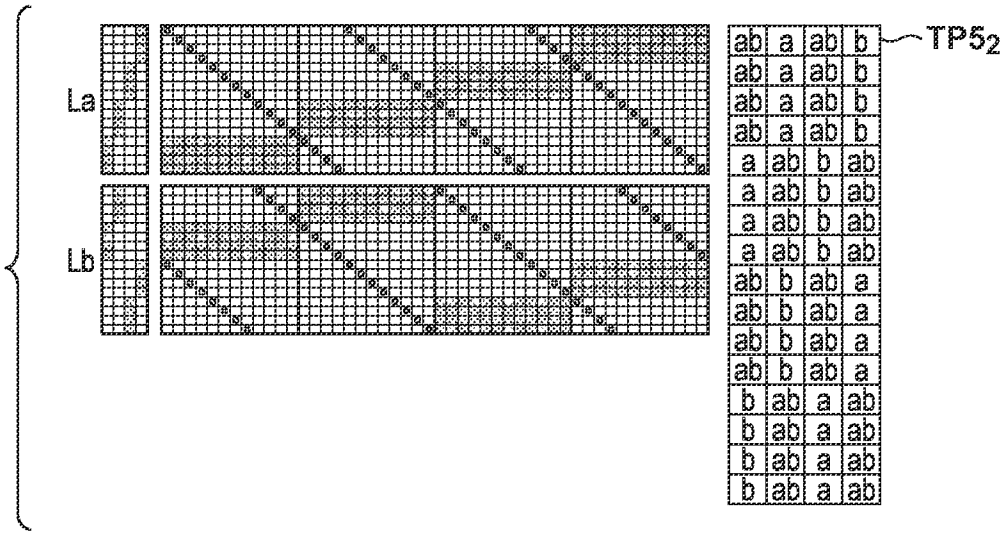

FIG. 17B shows restriction patterns corresponding to an example (v) shown in FIG. 16, that is, a case in which L=2, M=16, and P=12 (the number of non-driving nozzles is given by M−P=4), dots printed on the printing medium P in the example (v), and a table TP$\mathbf{5}_2$ in which nozzle arrays capable of printing dots at the same position are described. In the example (v), the number (M−P) of non-driving nozzles is smaller than M/L. Therefore, each of the blocks B#1 to B#16 may serve as a non-driving nozzle in one of the nozzle arrays La and Lb, or may never serve as a non-driving nozzle in either of the nozzle arrays La and Lb. In the former case, it is only necessary to print dots at the same print position by driving nozzles of the corresponding nozzles nz_o (or nozzles nz_e), and the number of dots which can be printed at the same print position is one. In the latter case, dots may be printed at the same print position by the nozzles nz_o (or nozzles nz_e) of either of the nozzle arrays La and Lb, and the number of dots which can be printed at the same print position is two. The average value of the numbers of dots which can be printed at the same print position is 1.5.

As exemplified above, the number P of driving nozzles is not uniquely determined based on the number L of nozzle arrays and the number M of blocks, and may be changed or adjusted within a range of M/L<P<M. According to this embodiment, it is also possible to change or adjust the print speed and gamut in accordance with specifications and the like.

(Others)

The four preferred embodiments of the present invention have been exemplified above with reference to a printing apparatus including an inkjet full-line printhead. The present invention, however, is not limited to these embodiments, and the embodiments may partially be changed or their features may be combined in accordance with the purpose or the like.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

In addition, the present invention is applicable to another aspect without departing from the spirit and scope of the present invention. For example, although an inkjet method using heating elements has been exemplified in each of the above-described embodiments, any printing methods such as a method using piezoelectric elements, a method using electrostatic elements, a method using MEMS elements, and other known printing methods may be used.

Furthermore, "printing" can include, in addition to printing of forming significant information such as characters and graphics, printing in a broad sense regardless of whether information is significant or insignificant. For example, "printing" need not be visualized to be visually perceivable by humans, and can also include printing of forming images, figures, patterns, structures, and the like on a printing medium, or printing of processing the medium.

In addition, "printing agent" can include a consumable used for printing in addition to "ink" used in each of the above-described embodiments. For example, "printing agent" can include a liquid which is used to process a printing medium or to process ink (for example, to solidify or insolubilize a colorant in ink applied onto a printing medium) as well as a liquid which is applied onto a printing medium to form images, figures, patterns, and the like. Furthermore, it is possible to adopt, for example, an arrangement configured to perform printing by applying ink onto an intermediate transfer medium and then transferring the ink onto a printing medium, instead of an arrangement configured to directly apply ink onto a printing medium. It is also possible to use an arrangement configured to perform monochrome printing using one type of ink (for example, black ink), instead of an arrangement configured to perform color printing using a plurality of types of inks.

In addition, "printing medium" can include any media capable of receiving a printing agent, such as cloth, plastic films, metal plates, glass, ceramics, resin, wood, and leather, as well as paper used in general printing apparatuses.

The definition of each term used in this specification for the sake of simplicity should be interpreted without departing from the spirit and scope of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-206673, filed Oct. 7, 2014, which is hereby incorporated by reference herein in its entirety.

What is claimed is:

1. A printing apparatus comprising:

a printhead for printing on a printing medium, including:

at least two nozzle arrays configured to print dots on the printing medium, the at least two nozzle arrays having the same length and being arranged in a first direction, and each nozzle array including a plurality of nozzles arranged along a second direction intersecting the first direction, and a plurality of printing elements provided so as to correspond to the plurality of nozzles of each nozzle array;

a driving unit configured to drive the plurality of printing elements by a time-divisional driving method such that ink dots are discharged from the plurality of nozzles of each nozzle array, the plurality of nozzles being divided into N (N is an integer not less than 2) groups, and each group including M (M is an integer not less than 2) nozzles and being driven at different timing periodically; and a print control unit configured to perform:

a first operation of expanding print data onto a memory in correspondence with the first direction and the second direction, a second operation of, for each nozzle array, for each unit column data corresponding to the second direction in the print data expanded in the first operation, determining some of the plurality of nozzles as non-driving nozzles such that the determined nozzles do not overlap each other between the at least two nozzle arrays in the first direction, and the remaining nozzles of the plurality of nozzles as driving nozzles, and a third operation of distributing the print data expanded in the first operation to the nozzle arrays so that printing of dots corresponding to each unit column data is completed by printing dots by the driving nozzles of each nozzle array determined in the second operation, wherein a length of an area in the second direction which is printable by one group in one period of the time-divisional driving method is shorter than a length of an area corresponding to the one group in the second direction, wherein, when L (L is an integer not less than 2, and M is a multiple of L) represents the number of nozzle arrays, and when P represents the number of nozzles determined as the driving nozzles in each group in the second operation, a relationship of $M/L<P<M$ is satisfied, and wherein the print control unit is configured to be capable of distributing the print data expanded in the first operation to the at least two nozzle arrays such that two or more dots are formed at a same printing position in the second direction based on each of column data in one period of the time-divisional driving method, the two or more dots corresponding to two or more nozzles being determined as the driving nozzles and belonging to a different nozzle array.

2. The apparatus according to claim 1, wherein a relationship of $P=M-M/L$ is further satisfied.

3. The apparatus according to claim 1, wherein a driving order of the M nozzles of each group is determined for every unit column data, and the print control unit performs the second operation based on the driving order.

4. The apparatus according to claim 1, wherein a time required to drive all the driving nozzles of the plurality of nozzles of each nozzle array once is set as a unit period of the time-divisional driving, and the print control unit performs the second operation by determining the non-driving nozzles and the driving nozzles of each nozzle array for each period so the non-driving nozzles determined for a first period do not overlap the non-driving nozzles determined for a next second period.

5. The apparatus according to claim 1, further comprising:

a storage unit, wherein the storage unit stores a reference table indicating priority levels for indicating a specific one of the nozzle arrays, whose driving nozzle is to be driven when the driving nozzles of the respective nozzle arrays overlap each other between the nozzle arrays in the first direction, and when the driving nozzles of the respective nozzle arrays overlap each other between the nozzle arrays in the first direction, the print control unit performs the third operation with reference to the reference table.

6. The apparatus according to claim 5, wherein the priority levels are shuffled for every period whose minimum unit is a value obtained by dividing the least common multiple of P and M by P.

7. The apparatus according to claim 1, wherein the print control unit further performs quantization processing for the print data in the first operation, the print data having undergone the quantization processing includes dot data for forming at least one dot at a given print position on the printing medium, and in order to form at least one dot at a given print position on the printing medium, the printhead executes, for the print position, printing based on the print data having undergone the quantization processing by using a nozzle corresponding to the at least one dot among the driving nozzles of each nozzle array.

8. The apparatus according to claim 1, wherein the at least two nozzle arrays print dots of the same color.

9. The apparatus according to claim 1, wherein the printhead is a full-line printhead, and the printing apparatus further includes a conveying unit configured to convey the printing medium in the first direction.

10. The apparatus according to claim 1, wherein the printhead includes a plurality of nozzle substrates arranged along the second direction, and the at least two nozzle arrays are formed by the plurality of arranged nozzle substrates.

11. The apparatus according to claim 10, wherein the plurality of nozzle substrates are arranged in a staggered pattern along the second direction.

12. A driving control method for a printhead for printing on a printing medium, the printhead including:

at least two nozzle arrays configured to print dots on the printing medium, the at least two nozzle arrays having the same length and being arranged in a first direction, and each nozzle array including a plurality of nozzles arranged along a second direction intersecting the first direction, and a plurality of printing elements provided so as to correspond to the plurality of nozzles of each nozzle array, the plurality of printing elements being driven by a time-divisional driving method such that ink dots are discharged from the plurality of nozzles of each nozzle array, the plurality of nozzles being divided into N (N is an integer not less than 2) groups, and each group including M (M is an integer not less than 2) nozzles and being driven at different timing periodically, the method comprising:

a first step of expanding print data onto a memory in correspondence with the first direction and the second direction;

a second step of, for each nozzle array, for each unit column data corresponding to the second direction in the print data expanded in the first step, determining some of the plurality of nozzles as non-driving nozzles such that the determined nozzles do not overlap each other between the at least two nozzle arrays in the first direction, and the remaining nozzles of the plurality of nozzles as driving nozzles, and a third step of distributing the print data expanded in the first step to the nozzle arrays so that printing of dots corresponding to each unit column data is completed by printing dots by the driving nozzles of each nozzle array determined in the second step, wherein a length of an area in the second direction which is printable by one group in one period of the time-divisional driving method is shorter than a length of an area corresponding to the one group in the second direction, wherein, when L (L is an integer not less than 2, and M is a multiple of L) represents the number of nozzle arrays, and when P represents the number of nozzles determined as the driving nozzles in each group in the second step, a relationship of $M/L<P<M$ is satisfied, and wherein the third step is capable of distributing the print data expanded in the first step to the at least two nozzle arrays such that two or more dots are formed at a same printing position in the second direction based on each of column data in one period of the time-divisional driving method, the two or more dots corresponding to two or more nozzles being determined as the driving nozzles and belonging to a different nozzle array.

* * * * *